US005440810A

United States Patent [19]

Borucki et al.

[11] Patent Number: 5,440,810

[45] Date of Patent: Aug. 15, 1995

[54] APPARATUS FOR FEEDING AND SPREADING LAUNDRY ARTICLES

[75] Inventors: Martin T. Borucki, Chicago; Kasimir Kober, Niles; Richard Michals, Skokie, all of Ill.

[73] Assignee: Chicago Dryer Company, Chicago, Ill.

[21] Appl. No.: 214,684

[22] Filed: Mar. 16, 1994

[51] Int. Cl.[6] ..... D06F 67/04

[52] U.S. Cl. ..... 38/143

[58] Field of Search ..... 38/143; 271/54, 79

[56] References Cited

U.S. PATENT DOCUMENTS

| | | | |
|---|---|---|---|
| 3,376,036 | 4/1968 | Weir | 271/54 |
| 3,421,756 | 1/1969 | Weir | 271/79 |
| 3,431,665 | 3/1969 | Weir | 38/143 |
| 3,509,649 | 5/1970 | Orkney et al. | 38/7 |
| 3,552,743 | 1/1971 | Baboz | 38/143 X |
| 3,664,046 | 5/1972 | Thompson | 38/143 |
| 3,729,846 | 5/1973 | Weir | 38/143 |
| 3,791,057 | 2/1974 | Hall | 38/143 |
| 3,911,604 | 10/1975 | Sjostrom | 38/143 |
| 4,050,173 | 9/1977 | Olsen | 38/143 |
| 4,106,227 | 8/1978 | Allen et al. | 38/143 |
| 4,143,476 | 3/1979 | Holmes et al. | 38/7 |
| 4,299,521 | 11/1981 | Jensen | 414/13 |
| 4,345,391 | 8/1982 | Weir | 38/143 |
| 4,378,645 | 4/1983 | Allen et al. | 38/8 |
| 4,411,083 | 10/1983 | Weir | 38/143 |
| 4,774,505 | 9/1988 | Ueda et al. | 340/674 |
| 4,885,853 | 12/1989 | McCabe | 38/143 |
| 4,991,326 | 2/1991 | Weir | 38/143 |
| 5,168,645 | 12/1992 | Robin et al. | 38/143 |
| 5,169,282 | 12/1992 | Ueda et al. | 414/786 |

FOREIGN PATENT DOCUMENTS 2091299 7/1982 United Kingdom ..... D06F 67/04

*Primary Examiner*—Clifford D. Crowder
*Assistant Examiner*—Ismall Izaguirre
*Attorney, Agent, or Firm*—Willian Brinks Hofer Gilson & Lione

[57] ABSTRACT

An apparatus is provided for loading, transferring, and spreading a sheet of laundry onto a conveyor. One aspect of the invention is to provide a clamp which has a pivot arm adapted to releasably grip a top corner portion of the sheet. The pivot arm is movable between a forwardly extending first position in which the corner portion of the sheet is gripped and a second position closer to the conveyor than the first position. A spreader mechanism spreads apart the top corner portion of the sheet and an opposite top corner portion of the sheet. Another aspect of the invention is to provide a pair of such clamps each having a pivot arm adapted to releasably grip a corresponding top corner portion of the sheet. The clamps are moved laterally apart to spread the sheet and returned to the receiving position after the pivot arms release the sheet. Yet another aspect of the invention is to fix one of the clamps to a first leg of an elongated endless member and to fix the other clamp to a second leg of the endless member. An inverter motor moves the endless member in one direction to spread the clamps apart and in an opposite direction to move the clamps toward each other. Another aspect of the invention is to provide a hanger which is moved between a transfer position where the clamps pick up the sheet and an input position lower than the transfer position.

29 Claims, 13 Drawing Sheets

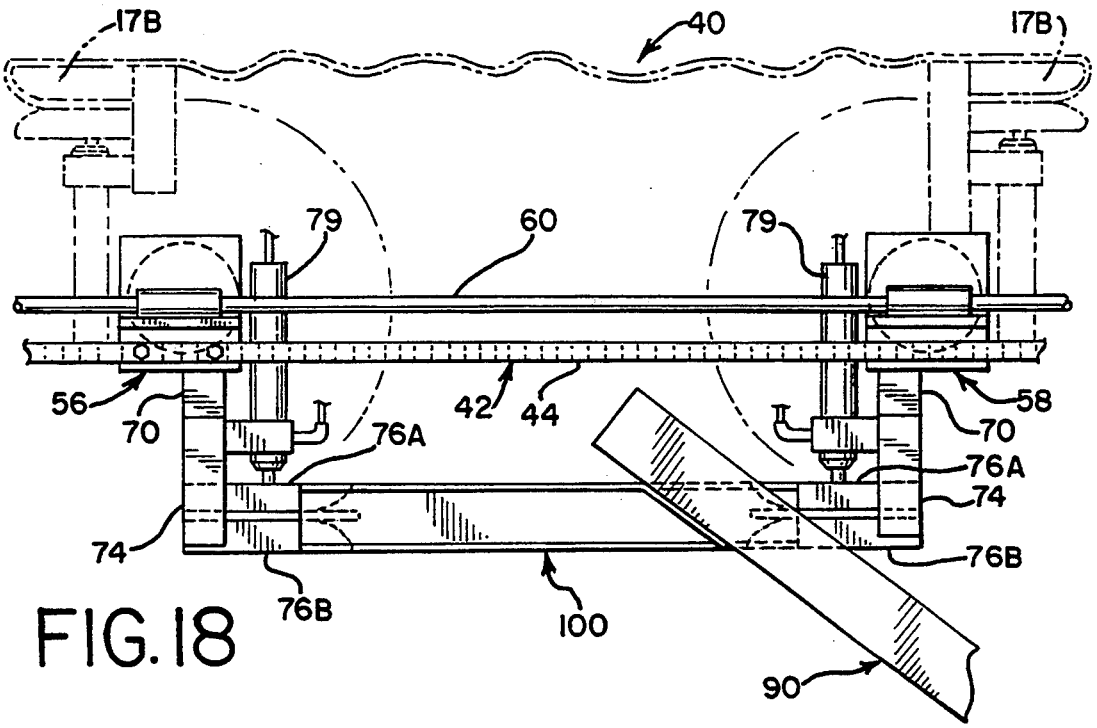
FIG. 18
FIG. 17
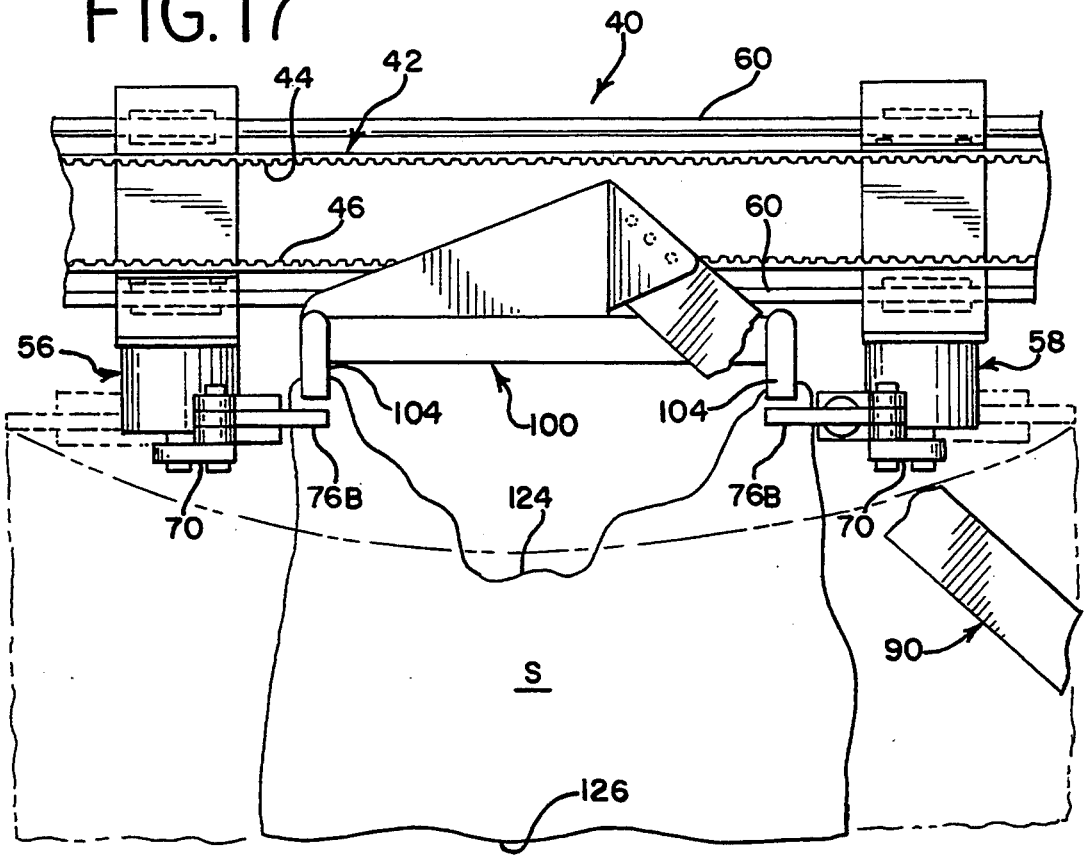

APPARATUS FOR FEEDING AND SPREADING LAUNDRY ARTICLES

BACKGROUND OF THE INVENTION

The present invention relates generally to laundry feeding machines, and more particularly, to loading, spreading, and feeding mechanisms which rapidly and accurately transfer and spread a sheet of laundry and place it onto a conveyor for subsequent processing by ironing machines, folding machines or the like.

After laundry articles such as bed sheets, table linens, blankets, or the like are washed in a laundry facility, they are typically fed into a flatwork ironer and automatic folder. The flatwork ironer dries and irons the wet sheets and the automatic folder folds and cross-folds the sheets into a neat package for use in hotels, hospitals, or the like. In order to obtain a neatly folded, unwrinkled package, it is important that the sheet be presented to the ironer with no wrinkles or folds and with the leading edge square. In the past, skilled operators have been employed to manually spread the sheet apart and place it in the ironer by hand. However, the use of operators tends to slow the output of the ironer and can lead to inaccurate placement of the sheet in the ironer. To overcome this difficulty, modern laundry facilities use an automatic spreader feeder apparatus to allow more rapid and accurate feeding of the sheets into the ironer.

These spreader feeder machines typically include a continuously moving conveyor on which the sheets are automatically laid with their leading edges perpendicular to the conveyor belts. In order to position the sheet for placement onto the conveyor, a pair of clamps are typically employed to grip opposing top corners of the sheet. The clamps are then moved apart by one or more endless belts to spread the sheet in front of the conveyor. To further assist in spreading of the sheet, a lower portion of the sheet is often spread between opposing pairs of lower endless flexible belts. Once the sheet is spread to the desired position, the clamps release the corners of the sheet and the upper portion of the sheet is forced onto the conveyor. The conveyor then advances the sheet to the ironer or other processing equipment. Various machines of this general type are disclosed in U.S. Pat. Nos. 4,885,853 to McCabe and 4,106,227 to Allen et al., and U.S. Pat. Nos. 4,967,495, 4,345,391, 3,421,756, and 3,376,036 to Weir.

In the machines disclosed in the '391, '756 and '036 patents to Weir, one clamp is attached to the upper run of an endless belt and another clamp is attached to the lower run of the belt. Thus, movement of the belt in one direction moves the clamps apart, and movement of the belt in the opposite direction moves the clamps together. In such devices where one or more belts are used to move the clamps in opposite directions, a reversible driving mechanism is provided to move the belt(s) in the desired direction. For example, the driving mechanism disclosed in the '756 patent to Weir is a friction clutch with a reversible electric motor or a double-acting pneumatic ram coupled to one of the clamps. To arrest the movement of the belt, a solenoid operated brake acts on the belt when a signal is received that the leading edge of the sheet has reached a certain height indicating a fully spread sheet. In the '227 patent to Allen et al., a reversible clutch-brake unit is provided to move the belts in the desired direction. Such complicated driving mechanisms are costly and difficult to maintain, and can be unreliable with extended use. In addition, the abrupt braking action of these mechanisms at a single end position can lead to inaccurate positioning and tensioning of the sheet. Such a braking action in conjunction with a constant speed drive can also make it difficult to retrieve a sheet which gets caught somewhere in the machinery. Another difficulty can occur when the sheet is not properly transferred to the clamps or when a corner portion of the sheet is released during the spreading operation. In these situations, one corner portion of the sheet is typically moved to the end position which can cause excessive downtime.

In some spreader feeder machines, the upper portion of the sheet is blown onto the conveyor after being released by the clamps. The '227 patent, for example, discloses a plurality of blowers positioned above the conveyor for blowing the sheet onto the conveyor. In other machines, the upper portion of the sheet is drawn onto the conveyor by a vacuum having an upwardly facing suction duct below the conveyor. A vacuum of this type is disclosed in U.S. Pat. Nos. 4,967,495 and 4,729,181 to Weir. In addition to forcing the upper portion or leading edge of the sheet onto the conveyor, it is desirable to hold down the lower portion or trailing edge of the sheet to keep the sheet taut as it moves on the conveyor to ensure a flat laydown of the sheet on the conveyor.

In order to facilitate loading of the sheets by an operator, some spreader feeder machines include mechanisms for transferring the clamps between the spreading area immediately in front of the conveyor and a position forwardly of the spreading area. This makes it easier and safer for an operator to place the corners of the sheet in the clamps. Typically, the clamps are mounted on a transverse beam which '15 in turn moves on rollers in a linear horizontal direction toward and away from the spreading area. In some of these machines, the sheets are loaded onto a separate clip and the clamps are adapted to remove the sheet from the clip. Machines of this type are disclosed in the '036 patent to Weir and U.S. Pat. No. 3,664,046 to Thompson. Because the entire spreading mechanisms of these devices are moved forwardly and rearwardly along with the beam, they tend to be cumbersome, costly, and inefficient.

Various spreader feeder machines are also designed to accommodate three operators at different loading stations. This increases the speed at which the sheets can be fed to the spreader clamps which improves the overall output of the spreader feeder machine. For example, the machines disclosed in the '036 and '046 patents include clips mounted on arms which swing laterally from an outer position to a center position where the clamps pick up the sheet. Because the outer swing arms move laterally to position the clips in the center area, the number of loading stations is limited to three. In addition, the moving parts may impede the motion of the operators and may present a safety risk during rapid loading of the sheets. Accordingly, it is desirable to provide more work stations with more reliable, faster, and safer loading mechanisms.

It is therefore desirable to provide a machine which facilitates user interface and operates more rapidly than other spreader feeder machines. It is also desirable to reduce the complexity of the machine and thereby facilitate reliability and maintenance and reduce costs of the machine.

SUMMARY OF THE INVENTION

Briefly stated, the invention is directed to an apparatus for loading, transferring, and spreading a sheet of laundry onto a conveyor or directly into an ironer. One aspect of the invention is to provide a clamp for transferring the sheet closer to the conveyor. The clamp has a pivot arm adapted to releasably grip a top corner portion of the sheet. The pivot arm is movable between a forwardly extending first position in which the corner portion of the sheet is gripped and a second position closer to the conveyor than the first position. A spreader mechanism is provided for spreading apart the top corner portion of the sheet and an opposite top corner portion of the sheet. Preferably, the pivot arm is rotatable about a vertical axis and extends horizontally forward in the first position and horizontally rearward in the second position. The use of such a pivot arm to transfer the sheet tends to be faster and more reliable than moving the entire clamp and spreading mechanism toward the spreading area. In addition, the present invention is simpler and less costly than complicated mechanisms utilizing rollers, beams, tracks, or the like.

Another aspect of the invention is to use a pair of such clamps to spread the sheet as well as transfer the sheet closer to the conveyor. In this aspect of the invention, each clamp has a pivot arm adapted to releasably grip a corresponding top corner portion of the sheet when the clamps are near each other in a receiving position. The pivot arms are movable, preferably simultaneously, between a forwardly extending first position in which the corner portions of the sheet are gripped and a second position closer to the conveyor. After the pivot arms have moved to the second position, a spreader mechanism moves the clamps laterally apart to spread the sheet. The spreader mechanism then returns the clamps to the receiving position after the pivot arms release the sheet. Preferably, the receiving position of the clamps is near the centerline of the conveyor, and the pivot arms are pivotable about a vertical axis. The use of a single pair of clamps to both transfer and spread the sheet further reduces the complexity and cost of the machine. Such an apparatus also increases the speed of operation and facilitates reliability and maintenance.

Yet another aspect of the invention is the spreader mechanism. An elongated endless member is provided having a first leg and a second leg which are substantially horizontal and parallel to each other. A pair of clamps are positionable adjacent each other near the centerline of the conveyor for receiving the corners of the sheet. One of the clamps is fixed to the first leg of the endless member and the other clamp is fixed to the second leg of the endless member. A drive mechanism is provided to move the endless member in one direction to spread the clamps apart and in an opposite direction to move the clamps toward each other.

Preferably, the drive mechanism includes an inverter motor adapted to reduce the speed at which the clamps are spread apart prior to when the clamps are completely spread apart. A plurality of position control sensors are also provided to send signals to the drive mechanism and the clamps. One of the sensors is adapted to signal when the sheet is in a proper initial loading position so that the clamps can grip the sheet. Another sensor is adapted to send a signal to the driving mechanism and clamps when a clamp has released the sheet during the spreading operation such that the driving mechanism reverses the direction of movement of the belt to move the clamps toward each other where the clamps release the sheet.

Also preferably, two pairs of endless flexible lower belts extend laterally outward from the centerline of the conveyor for receiving the sheet therebetween. The lower belts are movable in one direction to assist in spreading the sheet and movable in another direction to return the sheet to the center position if a corner portion of the sheet is released during the spreading operation. Preferably, the lower belts are driven by an inverter motor, and a position control sensor is adapted to send a signal to reverse the direction of movement of the lower belts when one of the corner portions of the sheet is released during the spreading operation to return the sheet to a center location for release of the sheet.

The use of a single endless belt with an inverter motor provides significant advantages over other mechanisms which use one or more belts with a driving mechanism such as a reversible electric motor and a friction clutch and brake. The present spreading mechanism has fewer component parts which decreases costs and facilitates reliability and maintenance. The response time for changing the direction of the belts may also be faster for an inverter motor. In addition, the inverter motor includes a slow-down phase at the end of the spreading operation which is less likely to cause an inadvertent release or loosening of the sheet than a friction brake or clutch which tends to abruptly stop the clamps. The overall operation of the spreader mechanism with an inverter motor tends to provide a more accurate spread of the sheet, and in conjunction with the position control sensors, provides multi-level jam prevention which facilitates retrieval of misfed sheets and minimizes down time of the machine.

Another aspect of the invention is to provide an apparatus which allows an operator to load the sheet from a relatively low input position. In this aspect of the invention, a hanger is adapted to grip opposing top corner portions of the sheet. A mechanism is also provided for moving the hanger between an input position and a transfer position. The input position is lower than the transfer position to provide easy access by an operator. A pair of clamps are positionable adjacent each other in the transfer position and are adapted to releasably grip corresponding top corner portions of the sheet. A mechanism is also provided for moving the clamps laterally apart to spread the sheet and returning the clamps to the transfer position to pick up another sheet.

Preferably, a plurality of hangers are provided for gripping opposing top corner portions of a sheet of laundry. A plurality of mechanisms are also provided to move the hangers between input positions and a transfer position at the centerline of the conveyor. The input positions are located below and forwardly of the transfer position and are spaced apart to allow operators simultaneous access to the hangers. Preferably, the mechanisms each comprise a longitudinal track along which the corresponding hangers slidably move. The tracks extend at an angle upwardly from spaced apart lower ends thereof toward the transfer position such that upper ends of the tracks are adjacent each other to substantially form an apex in the general vicinity of the transfer position. Also preferably, each mechanism includes a rodless pneumatic cylinder in operable engagement with the corresponding hanger to move the hangers between the lower ends and upper ends of the tracks.

The arrangement of the tracks of the present invention allows a greater number of operators to load the sheets on the hangers which increases the rate at which the sheets can be fed to the clamps for the transferring and spreading operations. In addition, the angled tracks allow the operators to load the hangers from a relatively low position which tends to be safer and reduce fatigue because the operators do not have to reach as high as they would if they were placing the sheets directly in the clamps. The tracks also allow the sheets to reach a higher spreading position so they do not touch the floor. The input positions of the angled tracks are also positioned forwardly of the spreading mechanism to further improve safety and provide more space for the operators. Moreover, the combination of the pivot arms of the clamps and the angled tracks maximizes the distance between the input positions of the operators and the spreading position of the sheet.

Another aspect of the invention is an apparatus for drawing the sheet toward the conveyor and ensuring a flat laydown onto the conveyor after the spread sheet is released by the clamps. A vacuum duct is positioned below the conveyor and has a substantially horizontally facing opening below and adjacent a front edge portion of the conveyor. The duct has a screen spanning the opening so that a portion of the sheet is drawn against the screen by a vacuum created within the duct. Thus, the sheet is drawn toward the conveyor and held taut as it is subsequently transported by the conveyor.

The present invention provides significant advantages over other spreader feeder machines. The invention as a whole facilitates user interface and operates more rapidly than other spreader feeder machines. It is also less complex than other machines, which facilitates reliability and maintenance and reduces the overall cost of the machine.

The present invention, together with further objects and advantages, will be best understood by reference to the following detailed description taken in conjunction with the accompanying drawings.

BRIEF DESCRIPTION OF THE DRAWINGS

FIG. 17 is a front fragmentary view of the clamps showing the pivot arms in a forwardly extending position gripping a sheet and a rearwardly extending spreading position indicated by phantom lines.

FIG. 18 is a top fragmentary view of the clamps shown in FIG. 17.

DETAILED DESCRIPTION OF THE PREFERRED EMBODIMENTS

Figure 1:
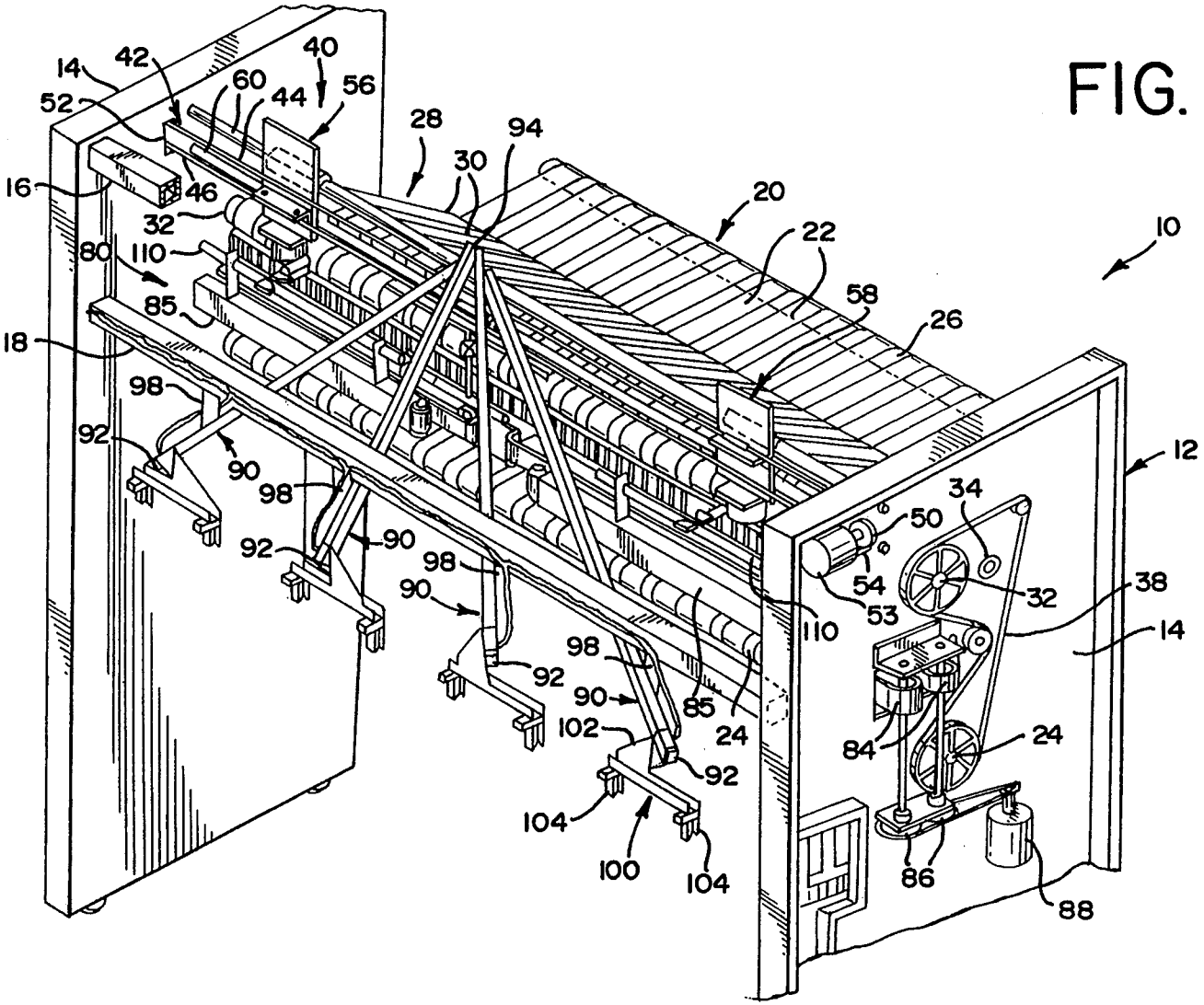
FIG. 1 is a perspective view of a laundry feeding apparatus with various components removed for clarity.
Figure 2:
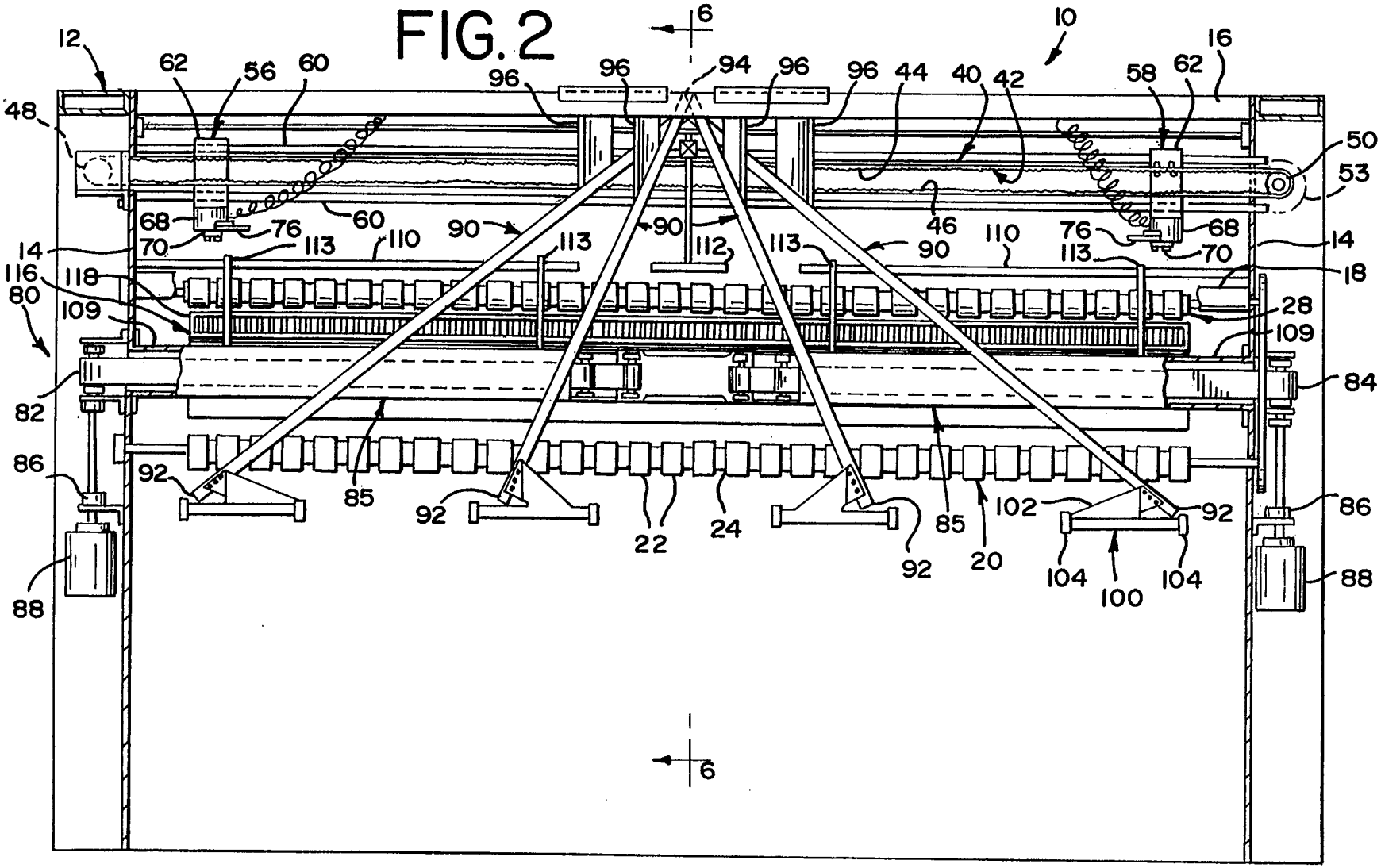
FIG. 2 is a front view of the apparatus.
Figure 3:
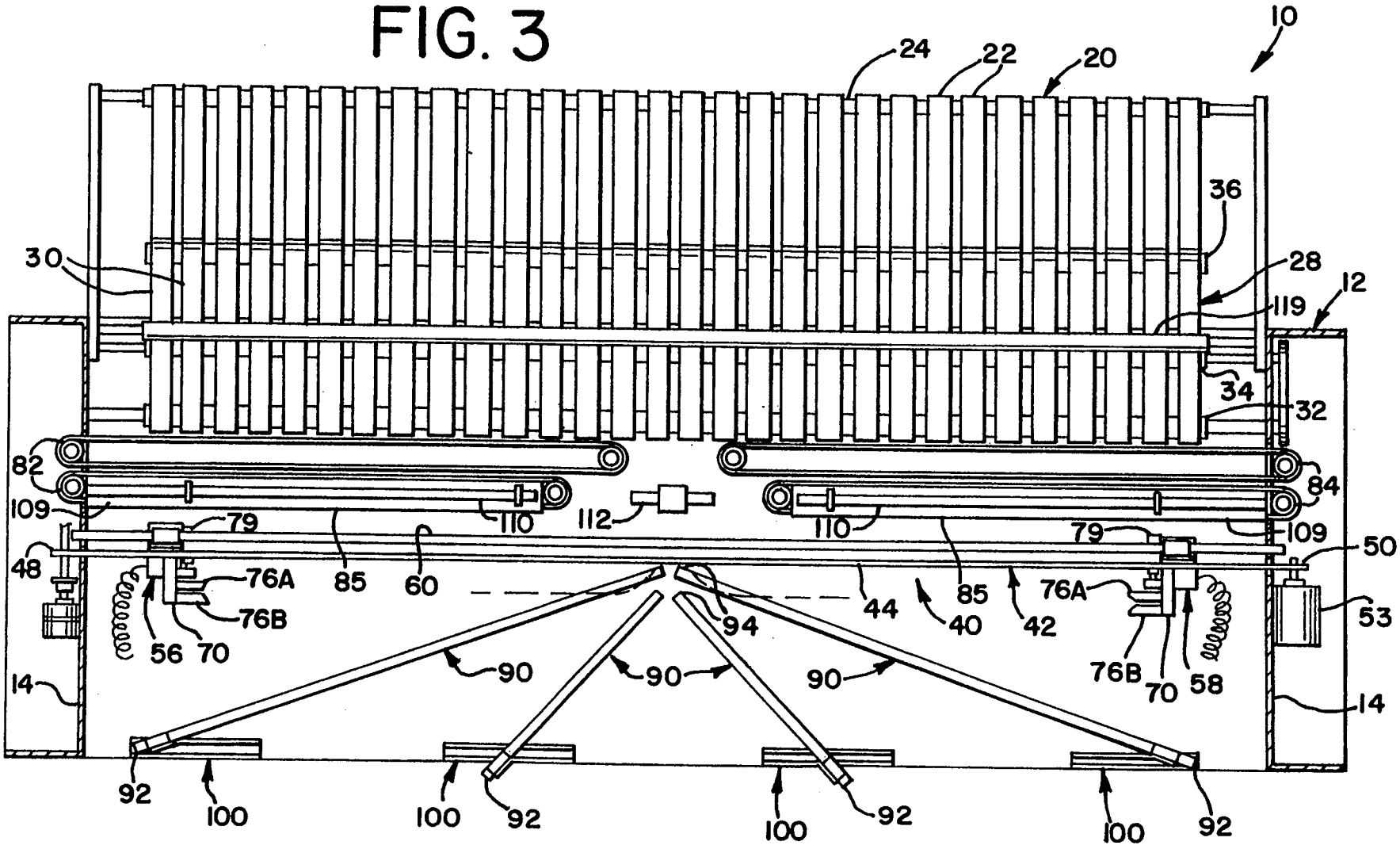
FIG. 3 is a top view of the apparatus.
Figure 5:
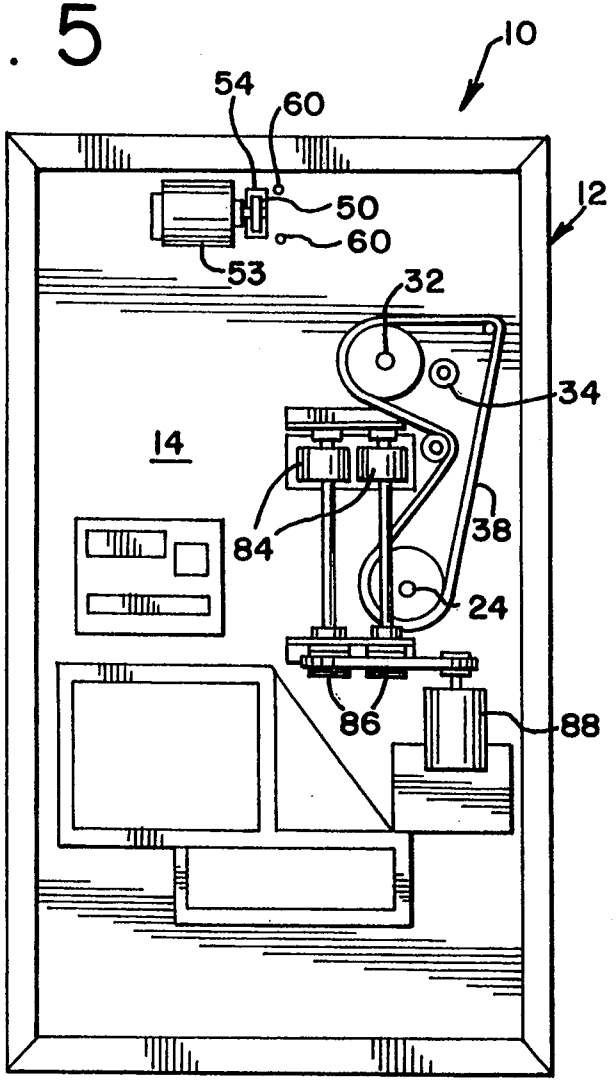
FIG. 5 is a right side view of the apparatus.
Figure 4:
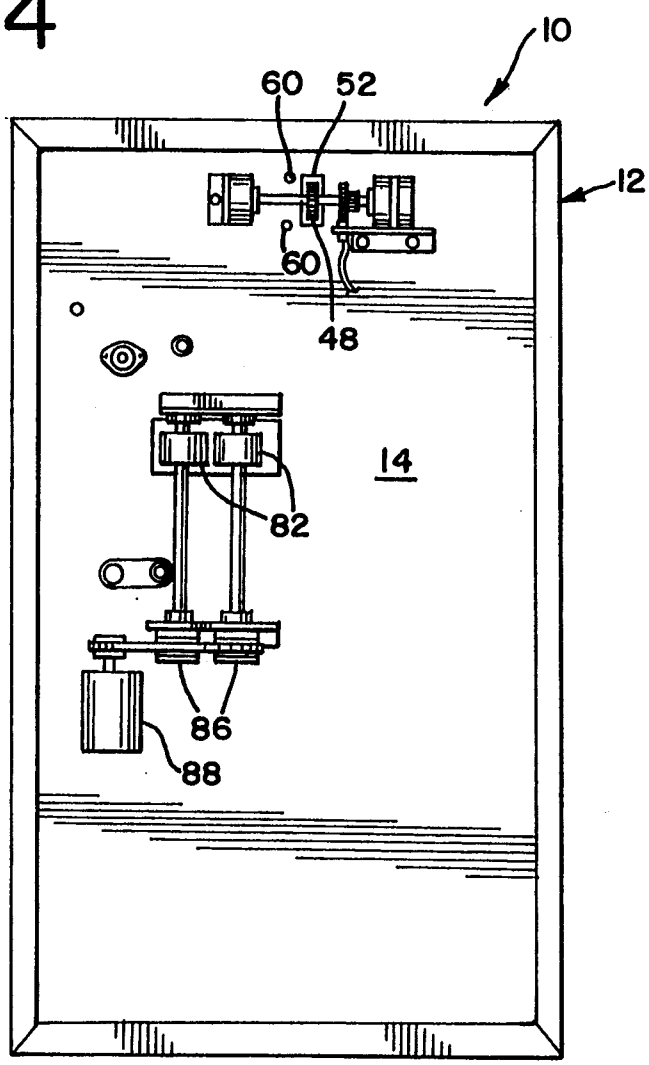
FIG. 4 is a left side view of the apparatus.

Referring to the drawings, FIGS. 1–6 show a preferred embodiment of a spreader feeder apparatus indicated generally at 10. The apparatus 10 includes a frame structure 12 having vertical side walls 14 with a pair of horizontal top cross-members 16 and a horizontal front cross-member 18 extending therebetween. A lower conveyor 20 extends horizontally between the side walls 14 approximately midway between the top and bottom of the side walls 14. The lower conveyor 20 includes a plurality of spaced apart, flexible endless belts 22 which extend around a front roller 24 and a rear roller 26. An upper conveyor 28 extends between the side walls 14 and is positioned above the lower conveyor 20. The upper conveyor 28 includes a plurality of spaced apart, flexible endless belts 30 which extend around a front roller 32, a middle roller 34, and a rear roller 36. The front roller 32 is positioned slightly below the middle roller 34 although it can lie in the same horizontal plane as the middle roller 34. The rear roller 36 is positioned rearwardly and below the rollers 32 and 34 adjacent the lower conveyor 20 to create an inclined portion of the upper conveyor 28. The front rollers 24 and 32 of the upper and lower conveyors 20 and 28 are driven through an endless belt 38 by an electric motor, preferably a $\frac{1}{2}$ HP motor with an inverter unit, and the rollers 26, 34 and 36 are idler rollers. The belts 22 and 30 are driven in a direction such that the upper runs of the belts 22 and 30 move rearwardly and the lower runs move forwardly. When a sheet is fed onto the upper conveyor 28, it is advanced rearwardly and then downwardly on the inclined portion 36 of the upper conveyor 28, and then rearwardly on the lower conveyor 20 to a flatwork ironer and automatic folder.

To transfer and spread a sheet for placement onto the upper conveyor 28, an upper spreader and transfer mechanism 40 is located above and in front of the conveyor 28. The mechanism 40 includes an elongated endless member 42 extending horizontally between the side walls 14 of frame 12. The endless member 42 has upper and lower legs 44 and 46 which are parallel to each other and extend around an idler pulley 48 and a drive pulley 50. The pulleys 48 and 50 are rotatably mounted to the exterior of the side walls 14 and the endless member 42 extends through corresponding openings 52 and 54 in the side walls 14. Preferably, the endless member 42 is in the form of a toothed belt, although other types of belts or chains can be used. The endless member 42 is driven through drive pulley 50 by a 3-phase AC squirrel cage motor 53 with an inverter unit. An inverter unit of this type is manufactured by Mitsubishi Corp. and sold as part number FRZ-024-0.75K. Preferably, the motor 53 is ⅓ HP and the inverter is a 1 HP unit.

To releasably grip, transfer, and spread a sheet of laundry, a pair of clamps 56 and 58 are mounted to the endless member 42. In the illustrated embodiment, the left clamp 56 is fixedly attached to the lower leg 46 and the right clamp 58 is fixedly attached to the upper leg 44 of the endless member 42. However, the clamps 56 and 58 can be coupled vice versa to the upper leg 44 and lower leg 46. As will be described in more detail below, the inverter motor 53 is adapted to move the endless member 42 in one direction to spread the clamps 56 and 58 apart and in an opposite direction to move the clamps toward each other. To guide the clamps 56 and 58 in a lateral direction, the clamps are slidably connected to a pair of horizontal guide bars 60 which are connected to the side walls 14 of frame 12. FIGS. 1–3, 8–11, and 19–20 show the clamps 56 and 58 in a fully spread apart position, and FIGS. 12–15 and 17–18 show the clamps adjacent each other in a receiving/transfer position near the centerline of the conveyor 28.

Figure 8:
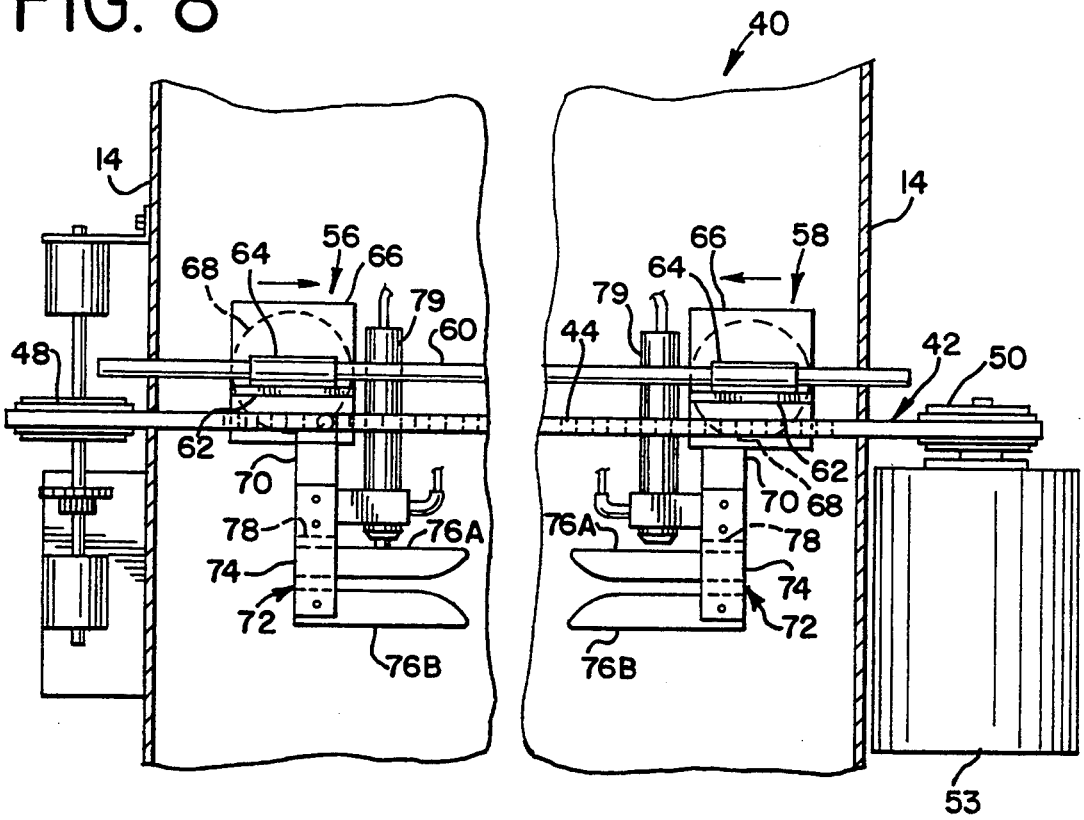
FIG. 8 is a fragmentary top view of a spreading mechanism including a pair of clamps each having a pivot arm shown in a forwardly extending position.
Figure 9:
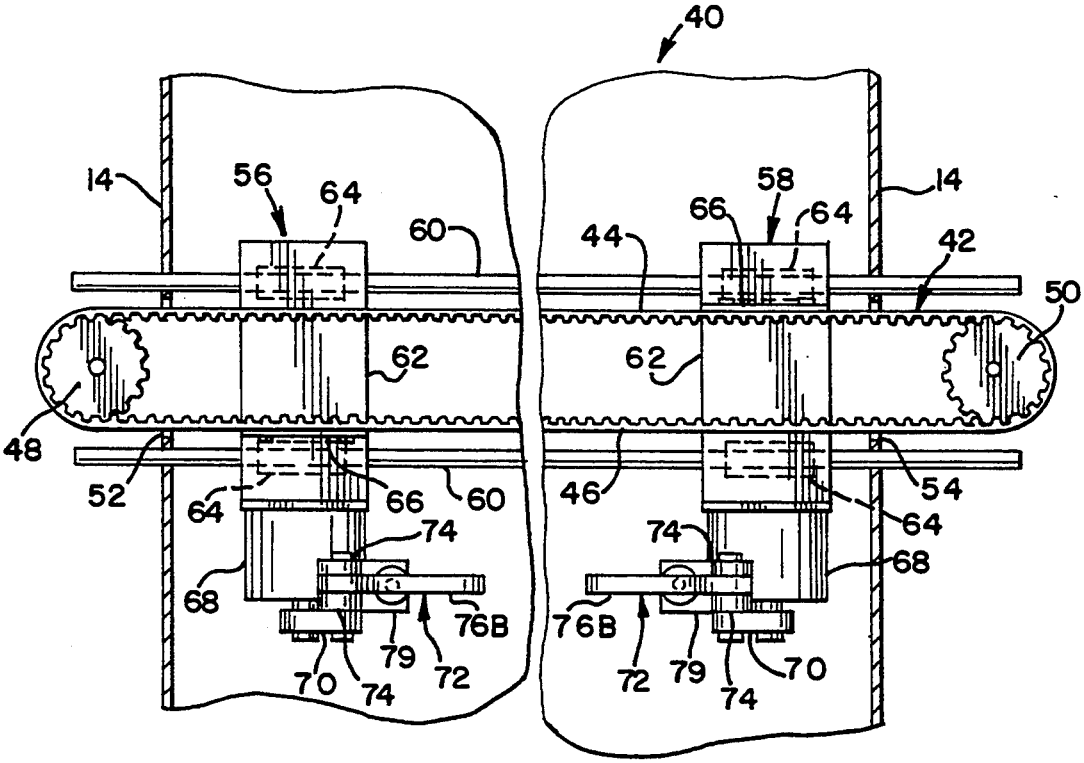
FIG. 9 is a fragmentary front view of the spreading mechanism shown in FIG. 8.
Figure 10:
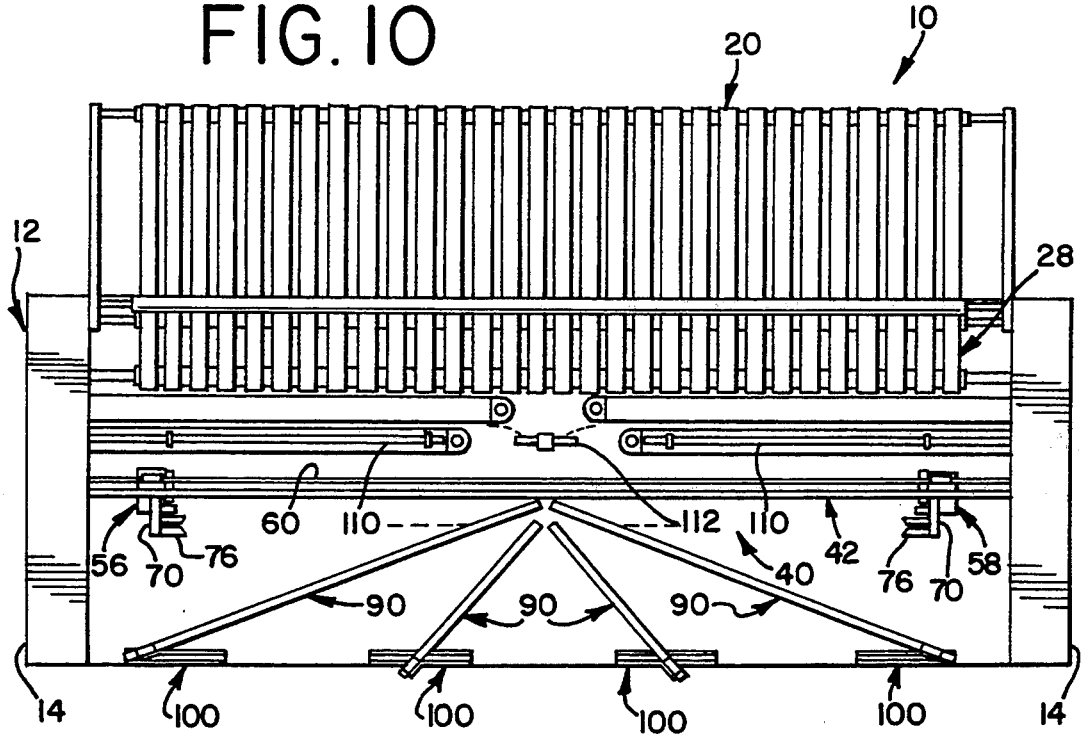
FIG. 10 is a top view of the apparatus showing the clamps spread apart and a plurality of hangers in initial input positions.
Figure 11:
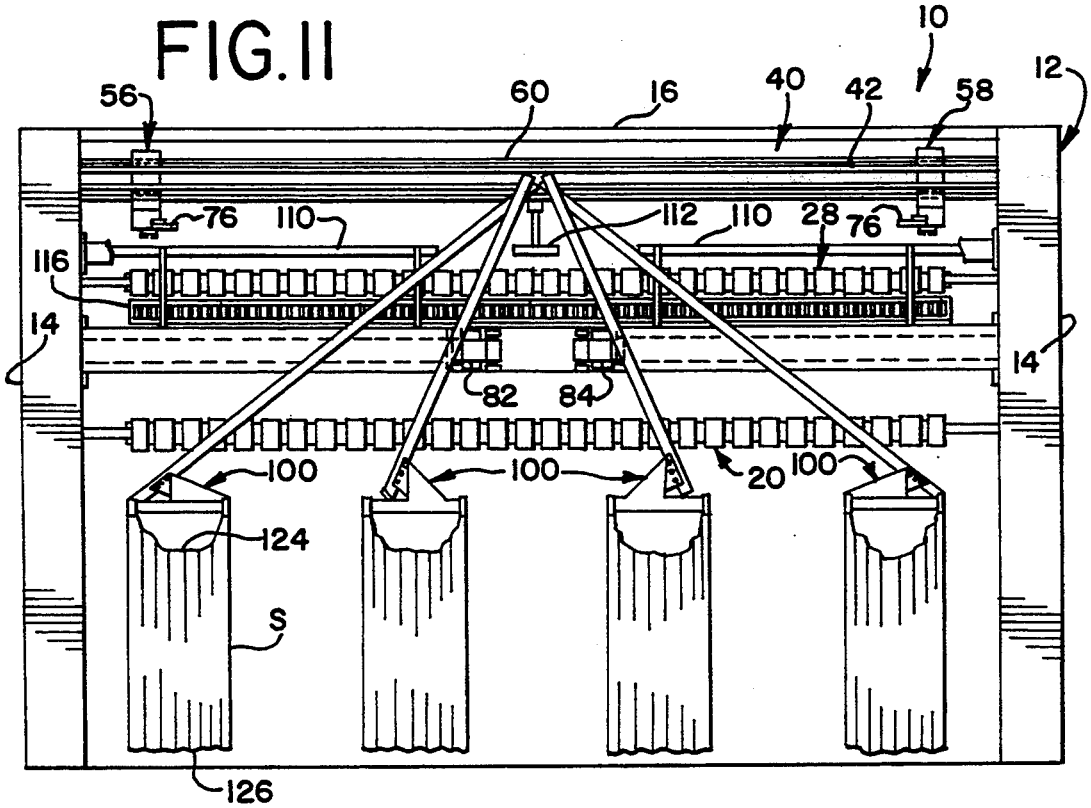
FIG. 11 is a front view of the apparatus shown in FIG. 10.

The structure of the clamps 56 and 58 is substantially identical and will be described with like numerals. As best shown in FIGS. 8–9, each clamp 56 and 58 includes a vertical plate 62 having a pair of spaced apart slide bearing assemblies 64 extending rearwardly therefrom. The bearing assemblies 64 preferably include THK linear slide bearings (not shown) through which the guide bars 60 pass. A horizontal plate 66 extends forwardly from a mid-portion of the vertical plates 62 for mounting the clamps to the respective legs 44 and 46 of the endless member 42. A pneumatically operated rotary actuator 68 of known design, preferably sold by Kuroda Corp. under the designation PRN305-180-45, is mounted to the bottom of the vertical plates 62. The actuators 68 are adapted to rotate a pivot arm 70 about a vertical axis between a forwardly extending first position and a rearwardly extending spreading position. To grip opposing top corner portions of a sheet of laundry, a clasp assembly 72 is mounted to an end portion of each pivot arm 70. The clasp assemblies 72 include a pair of vertically spaced extension arms 74 which extend outwardly from the pivot arms 70 in the same direction as the pivot arms. As viewed in FIG. 8 when the pivot arms 70 are in the forwardly extending first position, a pair of horizontal grippers 76 extend perpendicularly inward from between the extension arms 74. To releasably clamp opposing top corner portions of a sheet of laundry, an inner gripper 76A is slidable in a horizontal direction between an outer gripper 76B and a rear stop 78. The outer gripper 76B is fixedly attached between front end portions of the extension arms 74 and the rear stop 78 is fixedly attached between rear end portions of the extension arms 74. Preferably, the inner gripper 76A is actuated by a double acting pneumatic cylinder 79 to rapidly and securely clamp the corner portions of the sheet between the grippers 76.

To assist in spreading the sheet, a lower spreader mechanism 80 is positioned at a height between the lower and upper conveyors 20 and 28. The lower spreader mechanism 80 includes two pairs of endless flexible belts 82 and 84 which are driven through pulleys 86 by an inverter motor 88. The inverter motor 88 for the lower spreader mechanism 80 is preferably the same as the inverter motor 53 for the upper spreader and transfer mechanism 40. The pairs of belts 82 and 84 extend laterally outward from the centerline of the conveyor and are positioned forwardly of the conveyors 20 and 28 to receive a sheet therebetween. Preferably, two pairs of covers 85 are provided to protect the belts 82 and 84 while allowing sufficient space therebetween so that the sheet can engage the belts 82 and 84 during the spreading operation. When the pivot arms 70 of clamps 56 and 58 are moved from the forwardly extending position to the rearwardly extending position, a lower portion of a sheet is placed between the lower belts 82 and 84. The sheet is then spread by the lower belts 82 and 84 at approximately the same rate as the upper spreader mechanism 40. Preferably, the inverter motor 88 is adapted to move the belts 82 and 84 in the opposite direction to return the sheet to the center position if a corner portion of the sheet is released during the spreading operation.

Figure 7:
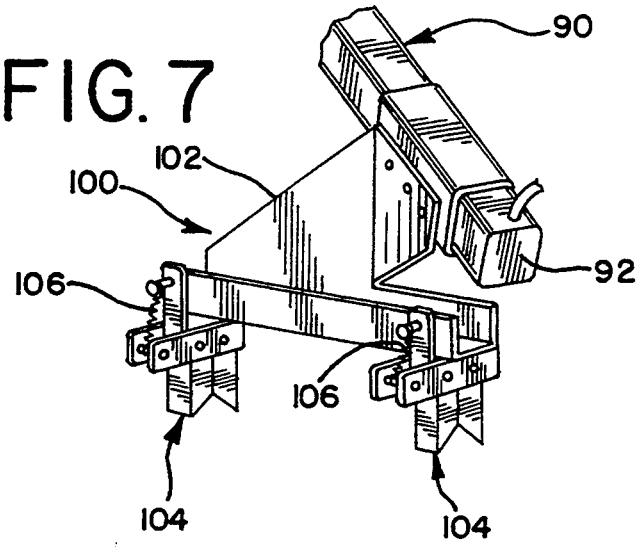
FIG. 7 is a perspective view of a hanger slidably mounted to a longitudinal track.
Figure 6:
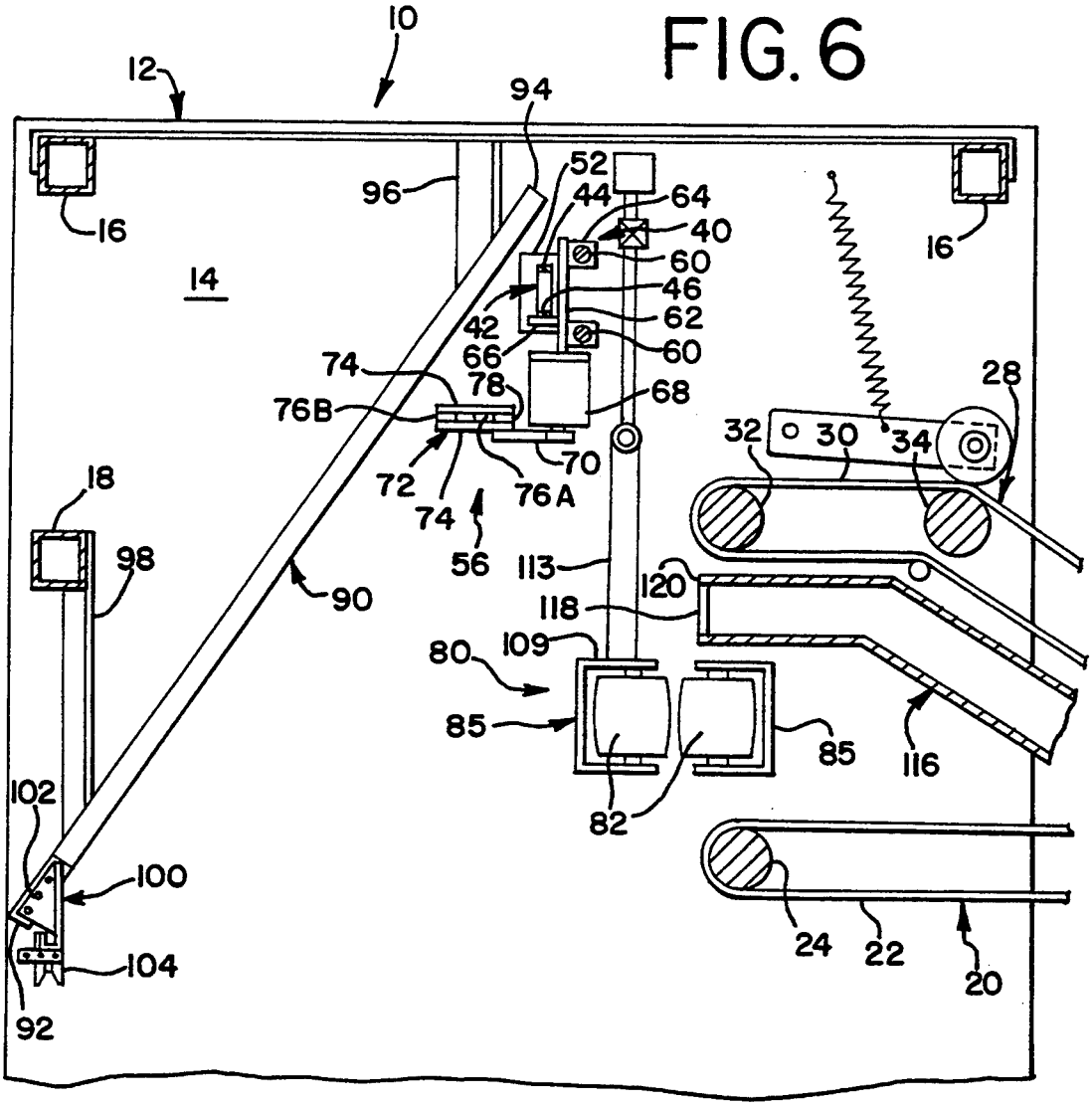
FIG. 6 is a cross-sectional view of the apparatus taken along the line 6—6 in FIG. 2
Figure 16:
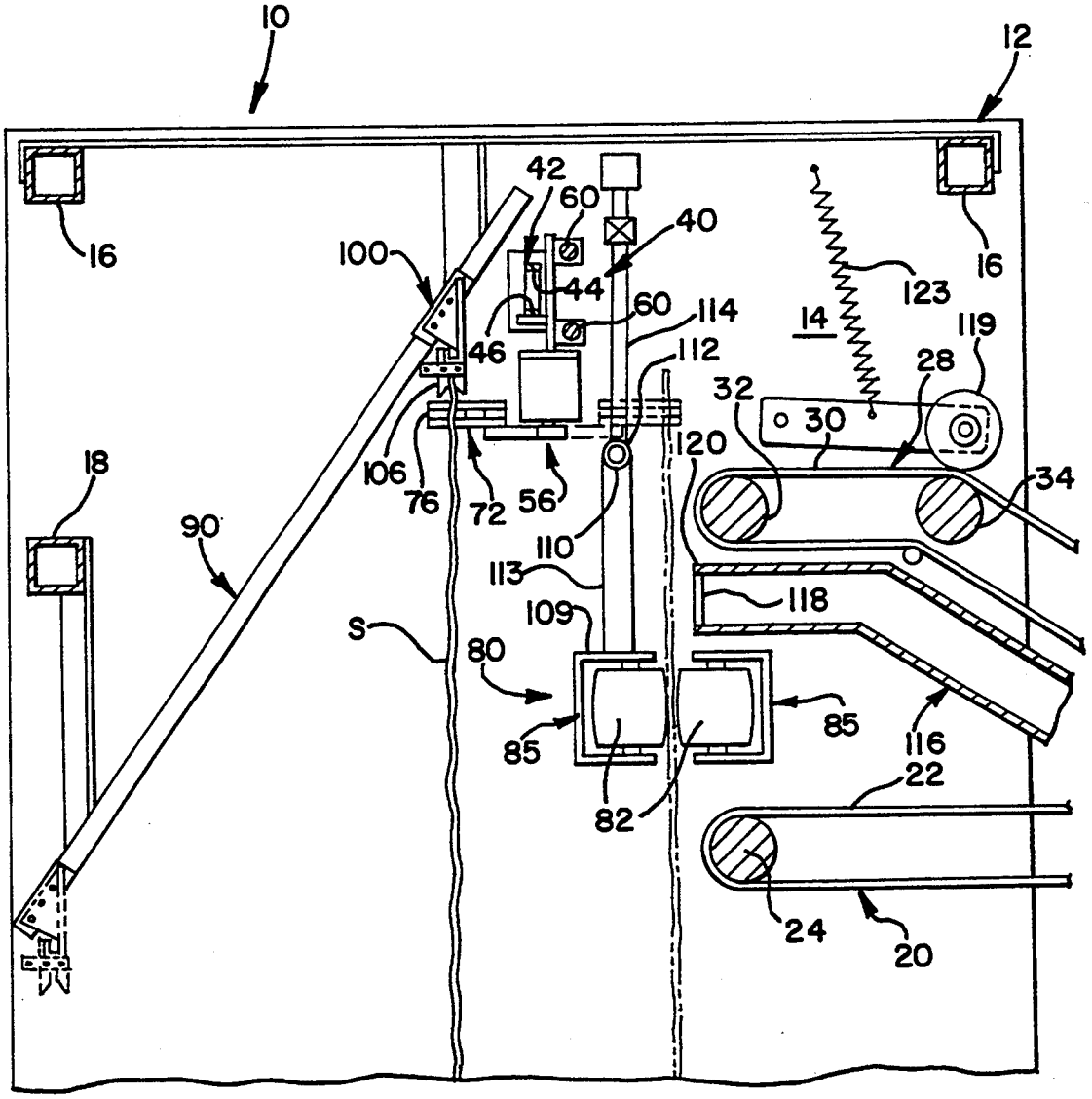
FIG. 16 is a cross-sectional view of the apparatus showing the pivot arms of the clamps in a forwardly extending position gripping a sheet and a rearwardly extending spreading position indicated by phantom lines.
Figure 19:
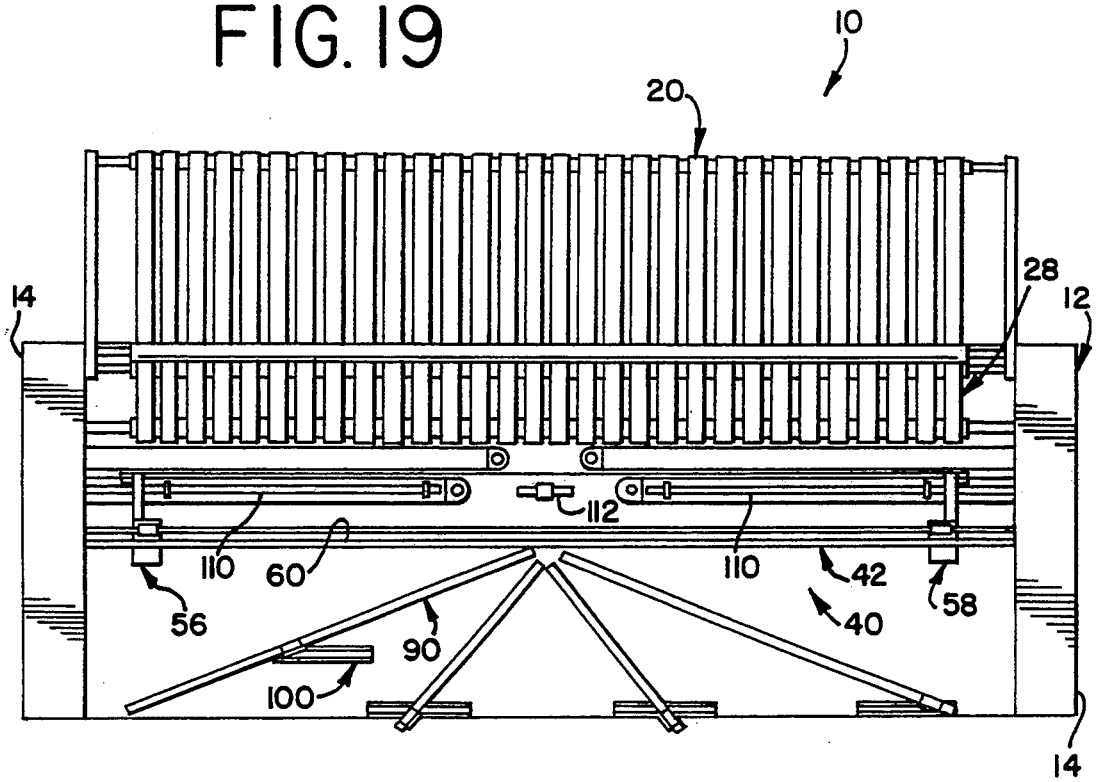
FIG. 19 is a top view of the apparatus showing the hanger moved closer to the input position and the clamps and sheet in a fully spread apart position.
Figure 20:
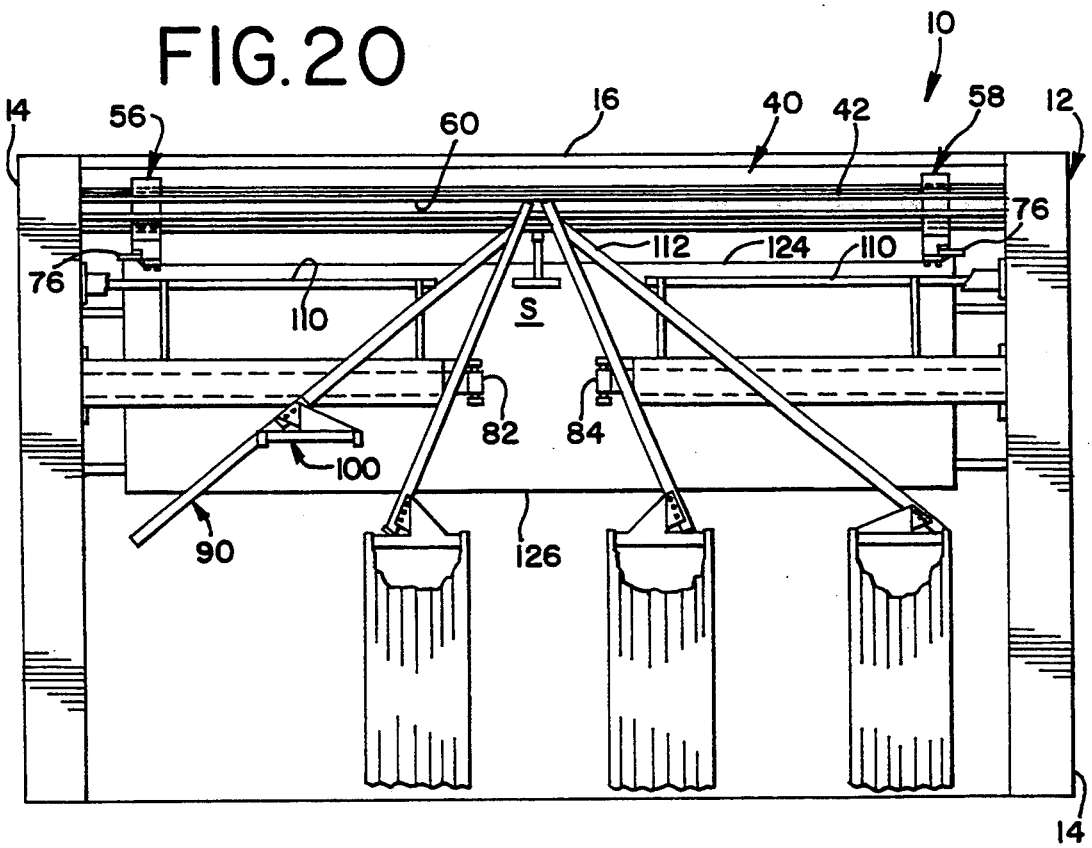
FIG. 20 is a front view of the apparatus shown in FIG. 19.

To allow rapid and convenient loading of sheets to the receiving/transfer position of the clamps 56 and 58, a plurality of longitudinal tracks 90 are positioned forwardly of the conveyor 28. The tracks 90 extend at an angle upwardly from spaced apart lower ends 92 toward the transfer position of the clamps 56 and 58. Preferably, the tracks 90 are positioned so that upper ends 94 form an apex above the clamps 56 and 58 in the transfer position at the centerline of the conveyor 28. The tracks 90 are mounted to the frame 12 by a plurality of upper brackets 96 and a plurality of lower brackets 98. A hanger 100 is slidably mounted on each track 90 for releasably receiving the top corner portions of a sheet. Preferably, a rodless pneumatic cylinder (not shown) is in operable engagement with each hanger 100 to move the hangers along the tracks 90 between a lowermost input position and an uppermost position. A rodless cylinder of this type is made by Tolomatic, Inc. The hangers 100 are mounted to the tracks 90 by angled brackets 102 to allow the uppermost position of the hangers to be in the same location for transferring the sheet. As best shown in FIG. 7, each hanger 100 includes a pair of spaced apart clips 104 biased by corresponding springs 106. When the hangers 100 are in the uppermost transfer position as shown in FIG. 16, the clips 106 are placed directly above the clasp assemblies 72 of the clamps 56 and 58. In addition, the clips 106 are spaced apart approximately the same distance as the clasp assemblies 72 to allow the clasp assemblies to pick up the top corner portions of the sheet from the clips.

To feed a sheet onto the conveyor 28 after it is fully spread, a pair of spaced apart, elongated air tubes 110 extend horizontally adjacent a front edge portion of the upper conveyor 28. The air tubes 110 are mounted to corresponding top walls 109 of the lower belt covers 85 by vertical brackets 113. Another relatively short air tube 112 is attached to a supply line 114 and extends horizontally between the air tubes 110. Preferably, the air tube 112 is aligned with the tubes 110 and is located near the centerline of the conveyor 28. The air tubes 110 and 112 each have a plurality of openings spaced apart along their lengths in a rear side thereof for directing jets of air rearwardly across the top of the conveyor 28. The size and positioning of the short tube 112 allows the sheet to pass underneath the tube 112 when the sheet is transferred from the forwardly extending transfer position to the rearwardly extending spreading position. When the clamps 56 and 58 are spread apart, the leading edge of the sheet rises above the air tubes 110 and 112. Thus, the air tubes 110 and 112 are all positioned forwardly of the sheet when it is in the fully spread position so that when the clamps 56 and 58 release the sheet, pressurized air forces the sheet rearwardly onto the conveyor 28.

To draw the sheet toward the conveyor 28 and ensure a flat laydown onto the conveyor, a vacuum duct 116 is positioned between the conveyors 20 and 28. A plurality of centrifugal fans (not shown) are incorporated in the vacuum duct 116 to create a desired air flow through the duct 116. To prevent the sheet from being drawn into the duct 116, a screen 118 extends across a horizontally facing opening 120 adjacent the front edge portion of the conveyor 28. Preferably, the screen 118 includes a plurality of spaced apart vertical bars, although any type of porous screen or material can be used such as a mesh or the like. When the clamps 56 and 58 release the fully spread sheet, the air tubes 110 and 112 blow a top portion of the sheet toward the conveyor 28, and the vacuum is activated to draw the sheet against the screen 118. To hold the sheet against the conveyor 28, an idler roller 119 is positioned adjacent the middle roller 34. The roller 119 is pivotally connected to the side walls 14 of the frame structure 12 by a pair of armitures 121. In order to reduce the force of the roller 119 acting on the sheet S, a spring 123 is connected to each armiture. Thus, the roller 119 holds down a trailing portion of the sheet S while the tubes 110 and 112 blow the top portion of a subsequent sheet. As a result, the air blast from the tubes 110 and 112 does not blow up the trailing edge of the sheet S, and the sheet remains flat on the conveyor 28 for a subsequent ironing operation.

Figure 12:
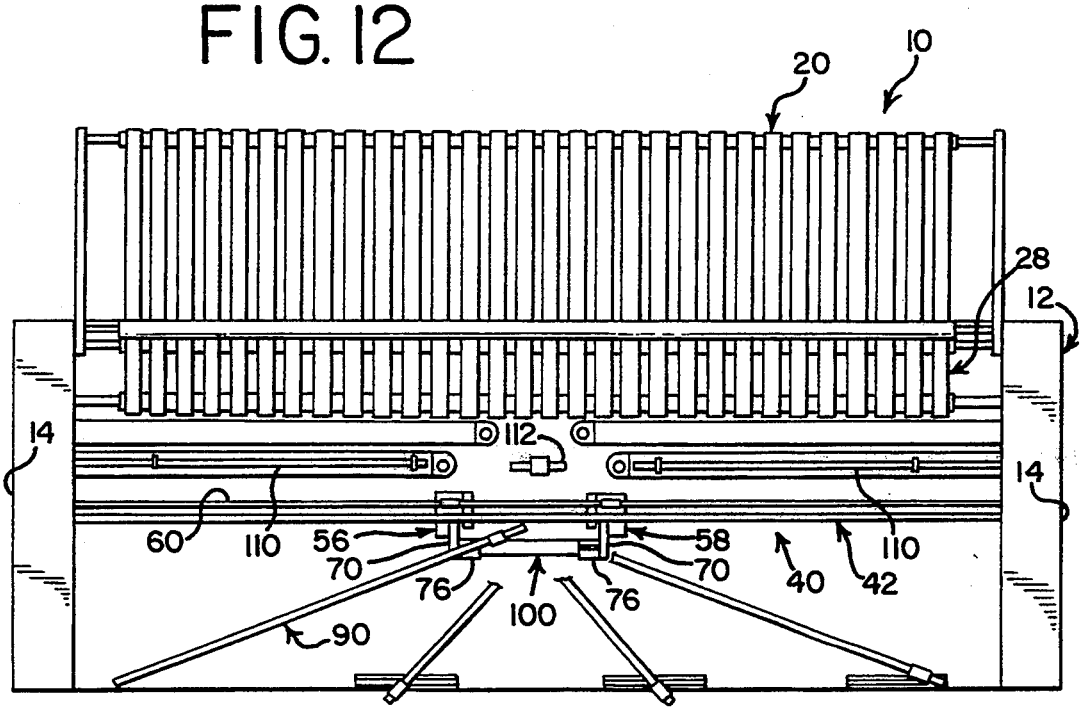
FIG. 12 is a top view of the apparatus showing the clamps adjacent each other in a transfer position with one of the hangers in the transfer position.
Figure 13:
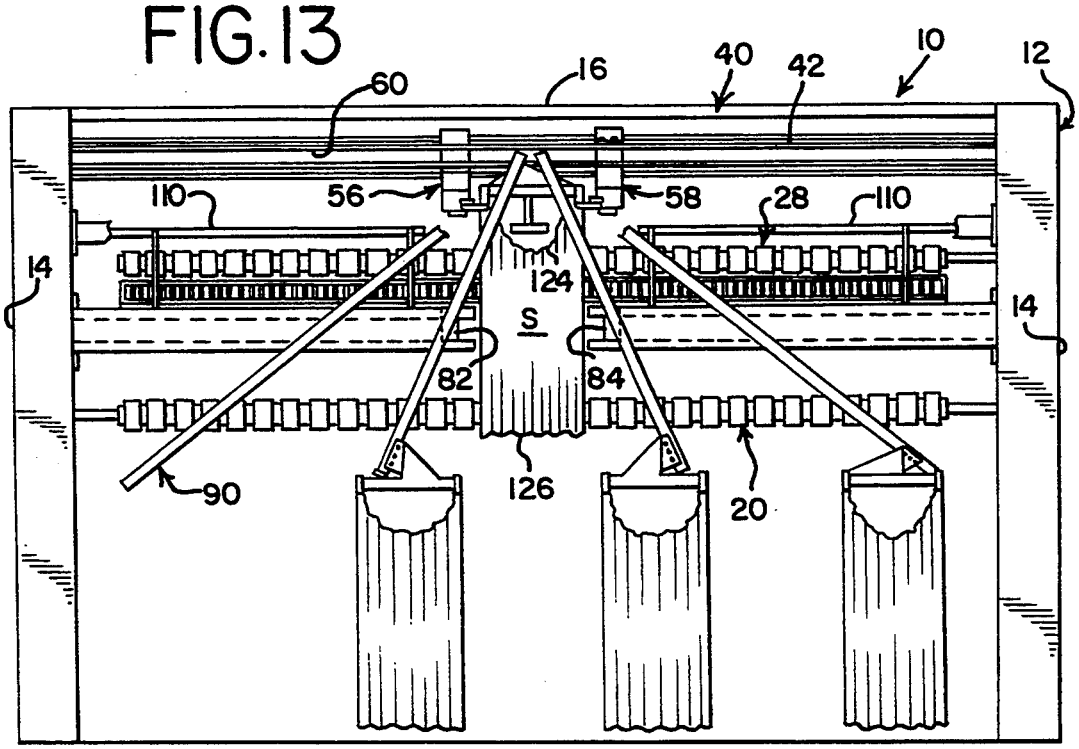
FIG. 13 is a front view of the apparatus shown in FIG. 12.
Figure 14:
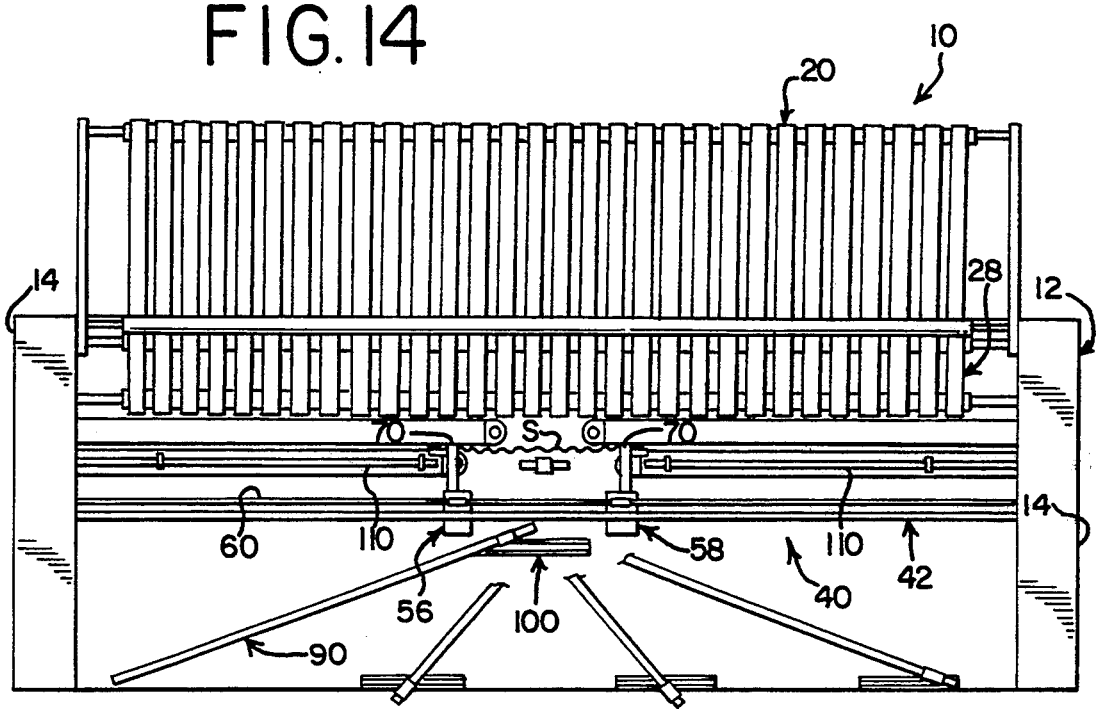
FIG. 14 is a top view of the apparatus showing the pivot arms of the clamps rotated to a rearwardly extending spreading position after receiving a sheet from the hanger.
Figure 15:
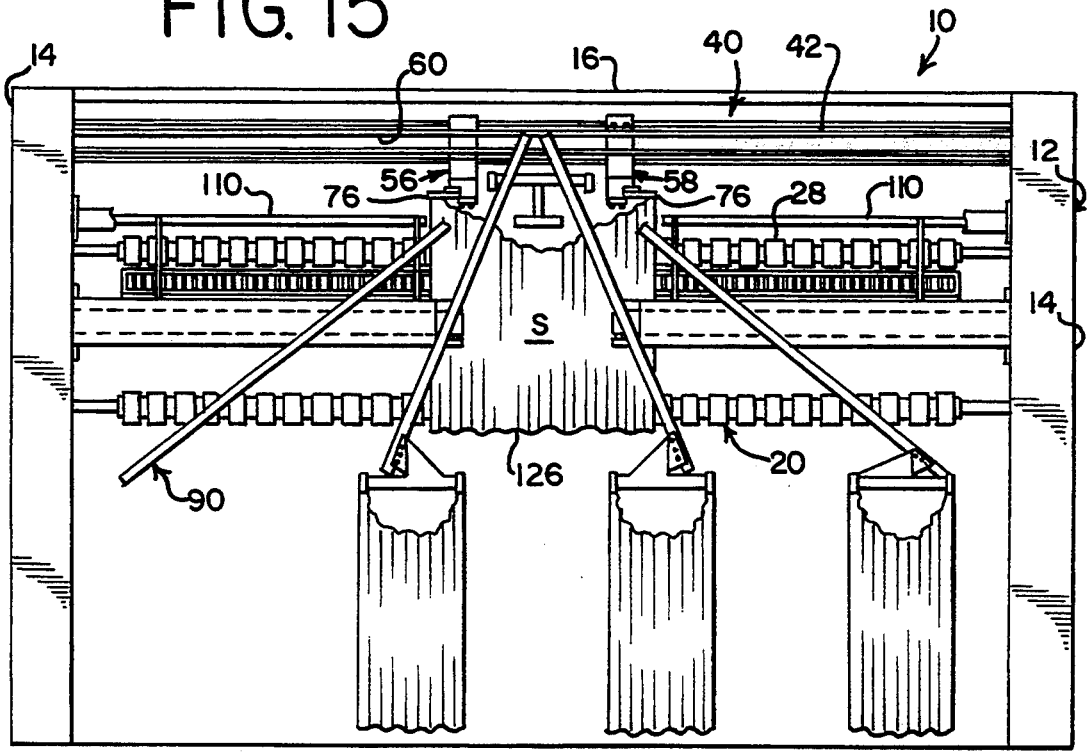
FIG. 15 is a front view of the apparatus shown in FIG. 14.

The operation of the spreader feeder apparatus will now be described with particular reference to FIGS. 10–23. A plurality of operators (not shown) stand in front of respective hangers 100 and place opposing top corner portions of a sheet S in the corresponding clips 94 when the hangers 100 are in the lowermost input positions. When a sheet S is secured in the hanger 100, the operator moves a hand over a proximity sensor (not shown) which is mounted on a plexiglass enclosure (not shown). The proximity sensor allows the operator to easily initiate the loading operation without having to locate and press a conventional button or the like. Preferably, the proximity sensors described herein are made by Electromatic and sold as P/N ACF10NP0. When the proximity sensor is activated, a signal is sent to the rodless cylinder to move the hanger 100 along the corresponding track 90 to the uppermost transfer position as shown in FIGS. 12, 13 and 16. When the hanger 100 reaches the transfer position, a photosensor (not shown) signals that the sheet S is ready to be gripped by the clamps 56 and 58. Preferably, the photoelectric sensors described herein are made by Microswitch and sold as P/N FE7B-DB6-M.

When the material ready signal is received, the clamps 56 and 58 move simultaneously toward each other with the pivot arms 70 in the forwardly extending position and the grippers 76 open. The clamps 56 and 58 move toward each other until a photosensor (not shown) indicates that they have reached the transfer position. As best shown in FIGS. 17 and 18, the open grippers 76 receive the top corner portions of the sheet S as the clamps reach the transfer position. A sensor (not shown) then sends a signal which causes the pneumatic cylinder 79 to close the grippers 76 and thereby clamp the corner portions of the sheet S. After a short time delay, the pivot arms 70 are rotated by the rotary actuators 68 to the rearwardly extending spreading position as shown in FIGS. 14–18. When the pivot arms 70 are rotated about 90°, a sensor on each clamp signals that the rotation is successful and the rotation is slowed by momentarily providing a pulsed air cushion. If one or both signals are not received within a predetermined time interval, the sheet S will be dropped and the arms 70 will return to the forwardly extending position for receiving another sheet. Preferably, the longitudinal axis of the pivot arms 70 and extension arms 74 of the clamps 56 and 58 are offset from the axis of the rotary actuator 68 (see FIG. 18). This provides an initial spread of the sheet S to assist in placing side edges of the sheet in between the pairs of lower belts 82 and 84. After the pivot arms 70 have rotated rearwardly to the spreading position, the endless member 42 is driven in the opposite direction to spread the clamps 56 and 58 apart and thereby spread the sheet S. At the same time, the lower belts 82 and 84 assist in spreading the sheet S.

To detect a leading edge 124 of the sheet S as it moves upwardly during the spreading operation, a leading edge photoelectric sensor (not shown) is provided. The sensor is preferably located about 24 inches below the clamps 56 and 58 in order to send a slow-down signal to the inverter motor 53 before the sheet S is fully spread. When the leading edge 124 of sheet S passes the sensor, a signal is sent to the inverter motor 53 to slow down the speed at which it drives the endless belt 42 and consequently the speed at which the clamps 56 and 58 are spread apart. Thus, the sheet S is slowly stretched at a predetermined torque during the end of the spreading operation to accurately control the tensioning of the sheet S. This slow-down phase prevents the sheet S from being torn or stretched out of shape and reduces the risk of an inadvertent release or loosening of the sheet S from the clamps 56 and 58.

The clamps continue moving apart until the rotary encoder indicates they have reached a position in which the sheet S is fully spread. A signal is then sent to the clamps 56 and 58 to release the corners of the sheet S and to activate the vacuum 116 and air tubes 110 and 112 (see FIGS. 19–20). After the sheet S is released, the clamps continue moving apart a short distance to straighten the just-released corner portions of the sheet S. As shown in dotted lines in FIG. 17, the corner portions are wrapped around the outer grippers 76A before they are released.

After a predetermined time delay, the clamps 56 and 58 reach a terminal position and a signal is sent to the inverter motor 53 to reverse the direction of the endless belt 42. In addition, a signal is sent to the rotary actuators 68 to rotate the pivot arms 70 to the forwardly extending position. The clamps 56 and 58 then move toward each other a short distance to a standby position where they await the material ready signal indicating that the next sheet is in the transfer position.

If the clamps 56 and 58 inadvertently release the sheet S during the spreading operation, a signal is sent to the inverter motor 53 to reverse the direction of movement of the endless member 42 to return the clamps 56 and 58 and the sheet to the transfer position. At the same time, a signal is sent to the inverter motor 88 to reverse the direction of the lower belts 82 and 84. When the clamps 56 and 58 have reached the transfer position, the grippers 76A release the sheet S. The clamps 56 and 58 then return to the standby position where they await the material ready signal for the next sheet.

Figure 23:
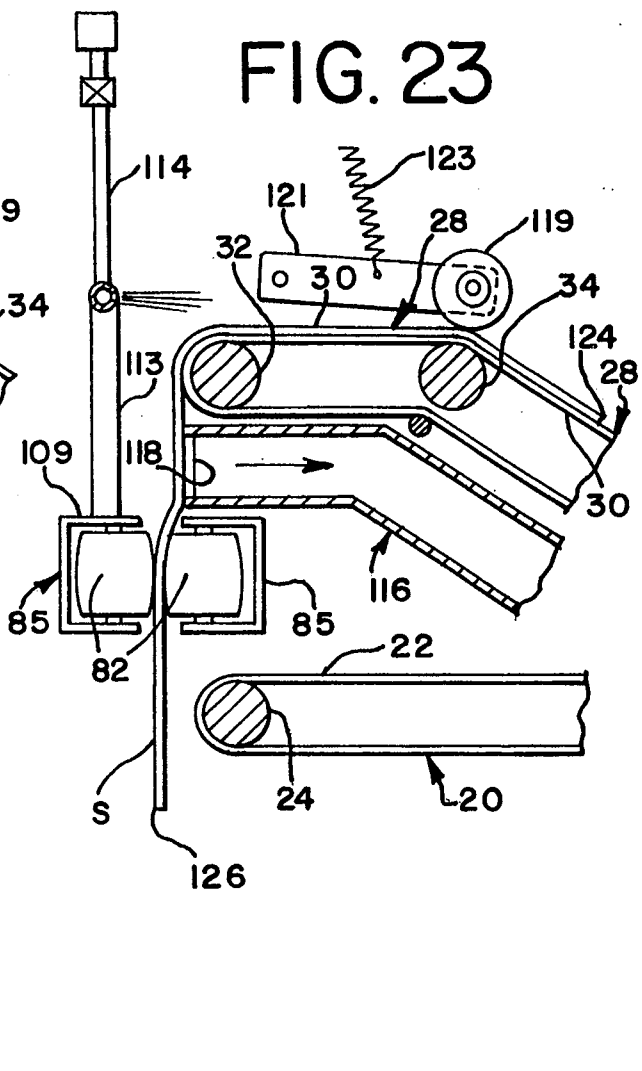
FIG. 23 is a fragmentary cross-sectional view of the apparatus showing the sheet after it has advanced a distance on the conveyor with a trailing portion being drawn against a vacuum duct.
Figure 22:
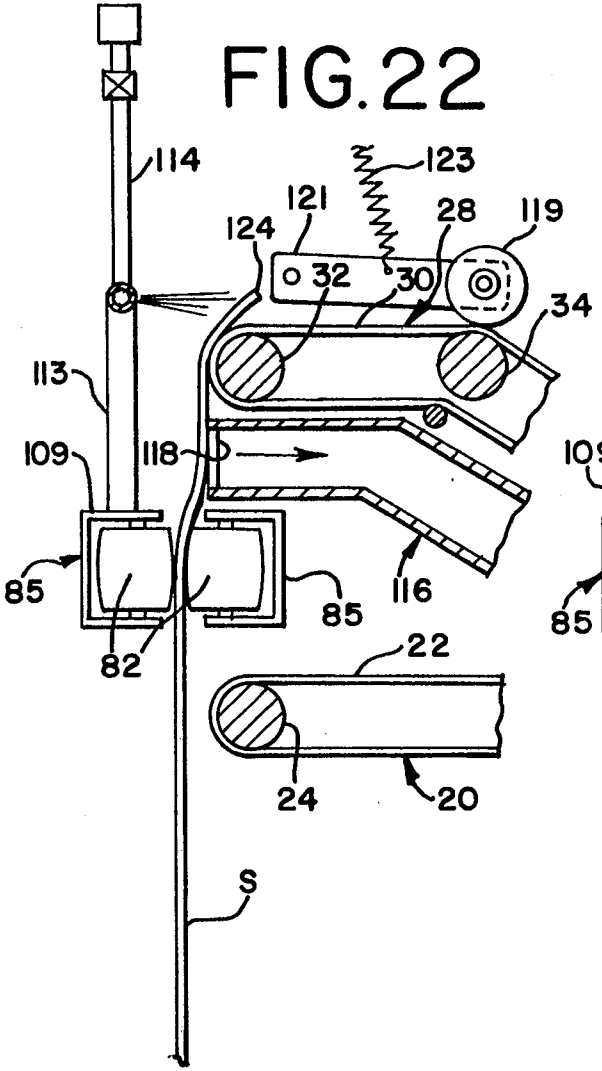
FIG. 22 is a fragmentary cross-sectional view of the apparatus showing a top portion of the sheet being blown down onto a conveyor with a lower portion drawn against a vacuum duct.
Figure 21:
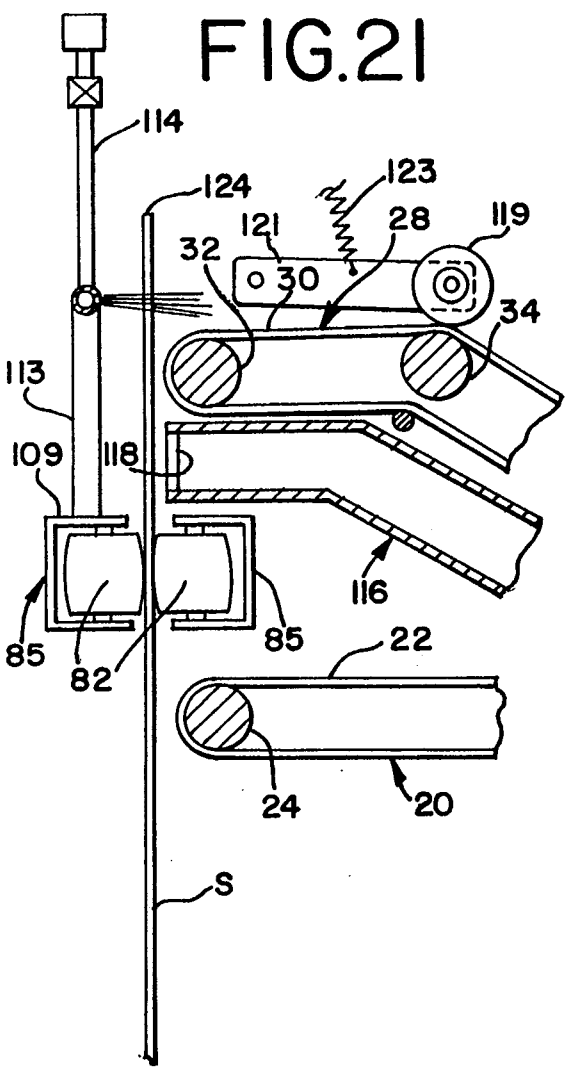
FIG. 21 is a fragmentary cross-sectional view of the apparatus showing the sheet in a fully spread position with the clamps removed for clarity.

As best shown in FIGS. 21–23, when the clamps 56 and 58 release the sheet S after a successful spreading operation, the air tubes 110 and 112 blow a top portion of the sheet S onto the conveyor 28. The sheet S is also drawn against the screen 118 of the vacuum duct 116, and the sheet S begins to advance rearwardly on the conveyor 28. After the sheet is blown onto the conveyor 28, the air tubes 110 and 112 are shut off and the sheet S continues to be drawn against the screen 118 until the sheet is completely on the conveyor 28. Thus, the vacuum duct 116 holds down the lower portion of the sheet as it advances on the conveyor 28 to keep the sheet taut and ensure a flat laydown on the conveyor 28. Even after the sheet S is completely on the conveyor 28, the roller 119 holds down the trailing portion of the sheet to prevent a subsequent air blast from blowing up the trailing portion of the sheet.

To control the continuous spreading of multiple sheets, a pair of trailing edge photoelectric sensors (not shown) are located below the leading edge sensor. If a trailing edge 126 of the sheet S has not passed the trailing edge sensors when the clamps 56 and 58 are in position for spreading another sheet, the inverter motor 53 will stop the endless member 42 to delay the spreading of the clamps. As soon as the trailing edge 126 has been detected, the inverter motor 53 is actuated to resume the spreading operation. This ensures that the first sheet S has advanced far enough on the conveyor 28 to avoid any overlap of the sheets.

To control the loading of the sheets along the tracks 90 to the transfer position, the rodless cylinders follow a "demand" sequence of operation. More particularly, the order in which the respective sets of hangers 100 are operated depends upon the order in which the machine operators activate the proximity sensors to signal their readiness after inserting their respective sheets in the corresponding hangers 100. As a result, the hangers 100 do not reach the uppermost position of the respective tracks 90 until the previous hanger 100 begins to move downwardly along its track 90 after the clamps 56 and 58 have picked up a sheet S.

Thus, a spreader feeder mechanism is provided which as a whole facilitates user interface and operates more rapidly and smoothly than other spreader feeder machines. It is also less complex than other machines which facilitates reliability and maintenance and reduces the overall cost of the machine.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. An apparatus for transferring a sheet of laundry from a first position spaced forwardly of a conveyor to a second position located closer to the conveyor, comprising:

a clamp having a pivot arm adapted to releasably grip a top corner portion of the sheet, said pivot arm being movable between said first position in which said top corner portion of the sheet is gripped and said second position; and a spreader mechanism adapted to spread said top corner portion of the sheet and an opposite top corner portion of the sheet laterally apart after the pivot arm has moved to the second position to allow spreading of the sheet after it has been moved closer to the conveyor.

2. The apparatus of claim 1 wherein the clamp is positionable in a center position near a centerline of the conveyor.

3. The apparatus of claim 2 wherein the clamp is movable in a lateral direction between said center position and a side position spaced from the centerline of the conveyor.

4. The apparatus of claim 1 wherein the pivot arm extends rearwardly toward the conveyor in said second position such that the sheet is in position for spreading by the spreader mechanism.

5. The apparatus of claim 4 wherein the pivot arm is substantially horizontal in the second position.

6. The apparatus of claim 1 wherein the pivot arm is rotatable about a substantially vertical axis.

7. The apparatus of claim 1 further comprising a second clamp having a pivot arm adapted to releasably grip said opposite top corner portion of the sheet, the pivot arms of the two clamps being movable simultaneously between a forwardly extending first position in which said corner portions of the sheet are gripped and a second position closer to the conveyor, said spreader mechanism adapted to spread the top corner portions of the sheet by one of gripping the top corner portions of the sheet and moving the two clamps apart while they maintain a grip on their respective top corner portions of the sheet.

8. The apparatus of claim 1 further comprising two pairs of endless flexible lower belts extending laterally outward from adjacent the centerline of the conveyor, each pair of belts adapted to capture a corresponding side edge of the sheet therebetween after the pivot arm has moved to the second position and while the sheet is depending from the pivot arm in order to assist in spreading the sheet.

9. An apparatus for transferring and spreading a sheet of laundry for placement on a conveyor, comprising:

a pair of clamps each having a pivot arm adapted to releasably grip a corresponding top corner portion of the sheet, said clamps and associated pivot arms being positionable near each other in a receiving position, and said pivot arms being movable between a first position for gripping the top corner portions of the sheet and a second position closer to the conveyor than said first position, whereby the pivot arms are disposed near each other in their respective second positions to allow spreading of the sheet after it has been moved closer to the conveyor; and a spreader mechanism for moving the clamps laterally apart after the pivot arms have reached the second position to spread the sheet.

10. The apparatus of claim 9 wherein the clamps are adjacent each other near a centerline of the conveyor in the receiving position.

11. The apparatus of claim 9 wherein the pivot arms extend rearwardly toward the conveyor in said second position.

12. The apparatus of claim 11 wherein the pivot arms are substantially horizontal in said second position.

13. The apparatus of claim 9 wherein the pivot arms are rotatable about a substantially vertical axis.

14. The apparatus of claim 9 wherein the spreader mechanism comprises an elongated endless member having a first leg and a second leg, one of said clamps being fixed to the first leg of the endless member and the other of said clamps being fixed to the second leg of the endless member.

15. The apparatus of claim 9 further comprising two pairs of endless flexible lower belts extending laterally outward from adjacent the centerline of the conveyor, each pair of belts adapted to capture a corresponding side edge of the sheet therebetween after the pivot arms have moved to their respective second positions and while the sheet is depending from the pivot arms in order to assist in spreading the sheet.

16. An apparatus for transferring and spreading a sheet of laundry into position for placement onto a conveyor, comprising:

an elongated endless member having a first leg and a second leg, said first and second legs being substantially horizontal and parallel to each other;

a pair of clamps each having a pivot arm adapted to releasably grip a corresponding top corner portion of the sheet, said pivot arms being movable between a forwardly extending first position for gripping the top corner portions of the sheet and a second spreading position closer to the conveyor than said first position, one of said clamps being fixed to the first leg of the endless member and the other of said clamps being fixed to the second leg of the endless member, said clamps being positionable adjacent each other in a center position near the centerline of the conveyor for receiving the corners of the sheet; and a drive mechanism adapted to move the endless member in one direction to spread the clamps laterally apart and in an opposite direction to move the clamps toward each other, wherein the clamps are spread apart after the pivot arms reach the second spreading position while maintaining a grip on the corner portions of the sheet to thereby spread the sheet, and wherein the clamps are moved toward each other after releasing the sheet to thereby return said clamps to said center position for receiving another sheet.

17. The apparatus of claim 16 further comprising two pairs of endless flexible lower belts extending laterally outward from adjacent the centerline of the conveyor and adapted to receive the sheet therebetween to assist in spreading the sheet.

18. The apparatus of claim 17 wherein the lower belts are movable in one direction to assist in spreading the sheet and movable in another direction to return the sheet to the center position if a corner portion of the sheet is released during the spreading operation.

19. An apparatus for spreading a sheet of laundry into position for placement onto a conveyor, comprising:

an elongated endless member having a first leg and a second leg, said first and second legs being substantially horizontal and parallel to each other;

a pair of clamps adapted to releasably grip opposite top corner portions of the sheet, one of said clamps being fixed to the first leg of the endless member and the other of said clamps being fixed to the second leg of the endless member, said clamps being positionable adjacent each other in a center position near the centerline of the conveyor for receiving the corners of the sheet; and a drive mechanism adapted to move the endless member in one direction to spread the clamps apart and in an opposite direction to move the clamps toward each other, wherein the clamps are spread apart while maintaining a grip on the corner portions of the sheet to thereby spread the sheet, said drive mechanism adapted to reduce the speed at which the clamps are spread apart prior to the clamps reaching a position where the sheet is fully spread, and wherein the clamps are moved toward each other after releasing the sheet to thereby return said clamps to said center position for receiving another sheet.

20. The apparatus of claim 19 wherein the driving mechanism comprises an inverter motor.

21. The apparatus of claim 19 wherein each clamp has a pivot arm adapted to releasably grip a corresponding top corner portion of the sheet, said clamps being positionable near each other in a receiving position, and said pivot arms being movable between a first position for gripping the top corner portions of the sheet and a second spreading position closer to the conveyor than said first position.

22. An apparatus for recovering a sheet of laundry which has been inaccurately spread during a spreading operation, comprising:

a pair of clamps positionable adjacent each other and adapted to releasably grip opposite top corner portions of the sheet;

a mechanism for moving the clamps laterally apart to spread the sheet and for returning the clamps to the position adjacent each other after the clamps have released the sheet;

a plurality of control sensors adapted to send signals to the moving mechanism and the clamps, one of said sensors adapted to signal when a clamp has improperly gripped a corner portion of the sheet, said signal causing both clamps to release the sheet, and one of said sensors adapted to send a signal to the moving mechanism and clamps when a clamp has released the sheet during the spreading operation such that the moving mechanism moves the clamps adjacent each other and the clamps then release the sheet.

23. The apparatus of claim 22 wherein the clamps are positionable adjacent each other in a center position near the centerline of the conveyor, and further comprising two pairs of endless flexible lower belts extending laterally outward from the centerline of the conveyor and adapted to receive the sheet therebetween, said lower belts being movable by a moving mechanism in one direction to assist in spreading the sheet and movable in another direction to return the sheet to the center position if a corner portion of the sheet is released during the spreading operation.

24. The apparatus of claim 23 further comprising a control sensor adapted to send a signal to the mechanism for moving the lower belts to reverse the direction in which the lower belts are moving when a clamp has released the sheet during the spreading operation.

25. An apparatus for loading, transferring and spreading a sheet of laundry for placement on a conveyor, comprising:

a hanger adapted to grip opposing top corner portions of a sheet of laundry;

a mechanism for moving the hanger between an input position accessible to an operator and a transfer position, said input position being lower than said transfer position;

a pair of clamps each having a pivot arm adapted to releasably grip a corresponding top corner portion of the sheet, said clamps being positionable adjacent each other near said transfer position and said pivot arms being movable between a grabbing position for grabbing the respective corner portions of the sheet from said hanger and a rearwardly extending spreading position; and a mechanism for moving the clamps laterally apart to spread the sheet and for returning the clamps to the transfer position to pick up another sheet.

26. The apparatus of claim 25 wherein the mechanism for moving the hanger is positioned such that the input position is located forwardly of said transfer position.

27. The apparatus of claim 25 further comprising a plurality of said mechanisms for moving a plurality of said hangers, each of the mechanisms comprising a longitudinal track along which the corresponding hanger slidably moves, said tracks extending at an angle upwardly from spaced apart lower ends thereof and toward the transfer position such that upper ends of said tracks are adjacent each other to substantially form an apex in the general vicinity of the transfer position.

28. The apparatus of claim 27 wherein the plurality of said mechanisms comprises four separate mechanisms.

29. An apparatus for loading, transferring and spreading a sheet of laundry for placement on a conveyor, comprising:

a plurality of longitudinal tracks positioned forwardly of the conveyor, each track extending at an angle downwardly and outwardly from a top portion thereof located generally at the centerline of the conveyor;

a hanger movably attached to each track, each hanger adapted to grip opposing top corner portions of a sheet of laundry and move along the track from a lower input position accessible to an operator to an upper transfer position at the top portion of the corresponding track;

a mechanism for moving each hangers along the tracks;

an elongated endless member having a first leg and a second leg, said first and second legs being substantially horizontal and parallel to each other;

a pair of clamps each having a pivot arm rotatable about a vertical axis and adapted to releasably grip a corresponding top corner portion of the sheet, one of said clamps being fixed to the first leg of the endless member and the other of said clamps being fixed to the second leg of the endless member, said clamps being positionable adjacent each other at a center location near the top portions of the tracks, and said pivot arms being rotatable between a transfer position for grabbing the corresponding top corner portions of the sheet from one of the hangers and a rearwardly extending spreading position;

a first drive mechanism adapted to move the endless member in one direction to spread the clamps apart and in an opposite direction to move the clamps toward each other;

two pairs of endless flexible lower belts extending laterally outward from the centerline of the conveyor and adapted to receive the sheet therebetween, said lower belts being movable in one direction to assist in spreading the sheet and movable in another direction to return the sheet to the center position if a corner portion of the sheet is released during the spreading operation;

a second drive mechanism adapted to move the lower belts in one direction to spread the sheet apart and in an opposite direction to move the sheet toward the center location; and a plurality of position control sensors adapted to send signals to the clamps and to the first and second drive mechanisms, one of said sensors adapted to signal when the sheet is in a proper initial loading position for being gripped by the clamps, and one of said sensors adapted to send a signal to the clamps and to the first and second drive mechanisms so that when a clamp has released the sheet during the spreading operation, the first drive mechanism reverses the direction of movement of the endless belt and the second drive mechanism reverses the direction of movement of the lower belts to return the sheet to the center location, and the clamps release the sheet;

whereby in normal operation a sheet is placed on one of said hangers and is moved upwardly along the corresponding track to the top portion of said track, the clamps are moved toward each other to the center location, the pivot arms of the clamps grab the corresponding top corner portions of the sheet from the hanger, the pivot arms move rearwardly to a spreading position, the clamps are moved apart to spread the sheet, the clamps release the sheet and the pivot arms return to a forwardly extending position, and the clamps are moved toward each other to the transfer position to grab another sheet, and if a corner portion of the sheet is released during the spreading operation the clamps and lower belts return the sheet to the transfer position and release the other corner portion of the sheet.

* * * * *